US005286598A

United States Patent [19]

Inoue et al.

[11] Patent Number: 5,286,598

[45] Date of Patent: Feb. 15, 1994

[54] SILVER HALIDE PHOTOGRAPHIC MATERIAL

[75] Inventors: Nobuaki Inoue; Minoru Sakai; Shigeru Ohno; Hisashi Okamura, all of Kanagawa, Japan

[73] Assignee: Fuji Photo Film Co. Ltd., Kanagawa, Japan

[21] Appl. No.: 967,742

[22] Filed: Oct. 28, 1992

[30] Foreign Application Priority Data

Oct. 28, 1991 [JP] Japan ..... 3-307162
Oct. 28, 1991 [JP] Japan ..... 3-307193

[51] Int. Cl.[5] ..... G03C 1/06

[52] U.S. Cl. ..... 430/264; 430/622; 430/957; 430/592; 430/593; 430/539

[58] Field of Search ..... 430/264, 622, 957, 592, 430/593, 539

[56] References Cited

U.S. PATENT DOCUMENTS

| | | | |
|---|---|---|---|
| 3,936,306 | 2/1976 | Minoda et al. | 430/539 |
| 4,102,688 | 7/1978 | Sugiyama et al. | 430/593 |
| 4,266,003 | 5/1981 | Ikeda et al. | 430/592 |
| 4,990,438 | 2/1991 | Ogi et al. | 430/622 |
| 5,085,971 | 2/1992 | Katoh et al. | 430/264 |
| 5,145,765 | 9/1992 | Okamura et al. | 430/264 |

FOREIGN PATENT DOCUMENTS

| | | | |
|---|---|---|---|
| 452848A1 | 10/1991 | European Pat. Off. . | |
| 0452848 | 10/1991 | European Pat. Off. | 430/264 |
| 0153132 | 4/1989 | Japan | 430/593 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

Disclosed is a high-sensitive and super-high contrast silver halide photographic material suitable to use in photomechanical process. The material comprises a support having thereon having at least one light-sensitive silver halide emulsion layer and another hydrophilic colloid layer, wherein at least one of the emulsion layer or the other hydrophilic colloid layer contains a hydrazine derivative and a redox compound capable of releasing a development inhibitor by oxidation and further contains at least one hardening agent represented by formula (A):

$$CH_2{=}CHSO_2\underset{\underset{R}{|}}{C}H(O\underset{\underset{R}{|}}{C}H)_nSO_2CH{=}CH_2 \qquad (A)$$

wherein R represents a hydrogen atom, a substituted or unsubstituted alkyl group, a substituted or unsubstituted aralkyl group or a substituted or unsubstituted aryl group; and n represents 0 or 1.

9 Claims, No Drawings

SILVER HALIDE PHOTOGRAPHIC MATERIAL

FIELD OF THE INVENTION

The present invention relates to a silver halide photographic material and, in particular, to a high-sensitive or super-high contrast silver halide photographic material to be used in photomechanical processes.

BACKGROUND OF THE INVENTION

In the field of photomechanical process technology, photographic materials with excellent original-producibility, stable processing solutions and simplified replenishment systems are required for the purpose of dealing with diversified and complicated print forms.

Originals employed in line work processes are often composed of phototypeset letters, hand-written letters, illustrations and halftone image photographs. Accordingly, an original may contain a plurality of images having different concentrations and different line widths in combination. Photomechanical cameras and photographic materials suitable for finishing the images from such originals with good reproducibility as well as image-forming methods applicable to such photographic materials are earnestly desired in this technical field. On the other hand, for the photomechanical processes used for producing catalogs or large-sized posters, spread or choke of half-tone photographs is widely effected. In the photomechanical processes using enlarged halftone image, the screen ruling would be coarsened to give blurred photoprints. As opposed to this, in the photomechanical processes for using reduced halftone image, fine dots with an enlarged ratio of lines/inch are to be photographed. Accordingly, an image-forming method with a much broader latitude is desired for the purpose of maintaining the reproducibility of halftone gradation in photomechanical processes.

As the light source for a photomechanical camera, a halogen lamp or xenon lamp is employed. In order to obtain sufficient photographic speed to the light source, the photographic material to be employed in the photomechanical process is generally ortho-sensitized. However, it was found that the ortho-sensitized photographic materials are much more influenced by the chromatic aberration of lens and therefore the quality of the images formed is frequently worsened by such an influence.

As a system of satisfying the demand for the broad latitude, a method is known where a lith-type silver halide photographic material composed of silver chlorobromide (having a silver chloride content of at least 50% or more) is processed with a hydroquinone-containing developer where the effective concentration of the sulfite ion therein is extremely low (generally, to 0.1 mol/liter or less). A line work or halftone image is obtained, having a high contrast and a high blacking density where the image portions and the non-image portions are clearly distinguished from each other. However, the method has various drawbacks. Specifically, since the sulfite concentration in the developer employed in the method is low, development is extremely unstable to aerial oxidation. For the purpose of stabilizing the activity of the processing solution, various means are tried. But the processing speed is extremely slow, and the working efficiency is poor at present.

Accordingly, an improved image-forming system is desired, which is free from the instability of the image formation in the above-mentioned development method (lith-development system) and which may be processed with a processing solution having an excellent storage stability to obtain photographic images having super-high contrast photographic characteristics. One example is a system of forming a super-high contrast negative image having a gamma value of more than 10, proposed for example in U.S. Pat. Nos. 4,166,742, 4,168,977, 4,221,857, 4,224,401, 4,243,739, 4,272,606 and 4,311,781. There, a surface latent image-type silver halide photographic material containing a specific acyl hydrazine compound is processed with a developer which has an excellent storage stability and which contains a sulfite preservative in an amount of 0.15 mol/liter or more, under a pH value of from 11.0 to 12.3.

The proposed image-forming system is excellent in that an image with a sharp halftone dot image quality is formed, the process proceeds stably at a high speed, and the reproducibility of the original used is good. However, a further improved system with a further elevated original reproducibility is still desired for the purpose of satisfactorily dealing with diversified print forms.

JP-A-61-213847, JP-A-64-72140, JP-A-2-287532, JP-A-2-293736, JP-A-2-301743 and JP-A-2-304433 (The term "JP-A" as used herein means as "unexamined published Japanese patent application") each mention a photographic material containing a redox compound capable of releasing a photographically useful group by oxidation for the purpose of improving the quality of the image to be formed thereon.

JP-A-62-222242, JP-A-62-237443, JP-A-62-237444, JP-A-63-296033 and JP-A-1-187542 each mention a silver halide photographic material containing a hydrazine compound, in which the swelling rate and the kind of the hardening agent to be therein play an important role in improving the photographic characteristics and the image quality and in preventing formation of black peppers.

European Patent Application No. 452848A discloses that swelling of the emulsion layer in a photographic system containing a redox compound capable of releasing a development inhibitor by oxidation is important for the image quality of the system. In the system, however, there is the problem that the image quality as well as the long-time storage stability against the formation of black peppers often deteriorate, depending upon the selected hardening agent or the water content in a gelatin layer.

SUMMARY OF THE INVENTION

One object of the present invention is to provide a silver halide photographic material for photomechanical processes, which contains a hydrazine derivative, which has an excellent image quality for line works or for spread, and which involves the generation of only a few black peppers.

Another object of the present invention is to provide a silver halide photographic material, which hardly deteriorates with respect to the image quality and reduced generation of black peppers, even after being stored for a long period of time or stored under a high temperature condition.

Still another object of the present invention is to provide a silver halide photographic material, which is highly sensitive and is highly safe to a safelight.

These and other objects have been attained by a silver halide photographic material comprising a support having thereon at least one light-sensitive silver halide emulsion layer and another hydrophilic colloid layer, wherein at least one of the emulsion layer or the other hydrophilic colloid layer contains a hydrazine derivative, and a redox compound capable of releasing a development inhibitor by oxidation and further contains at least one hardening agent represented by formula (A):

$$CH_2{=}CHSO_2\underset{\underset{R}{|}}{CH}(OCH)_n\underset{\underset{R}{|}}{}SO_2CH{=}CH_2 \quad (A)$$

wherein R represents a hydrogen atom, a substituted or unsubstituted alkyl group, a substituted or unsubstituted aralkyl group or a substituted or unsubstituted aryl group; and n represents 0 or 1.

DETAILED DESCRIPTION OF THE INVENTION

Compounds represented by formula (A) which are used in the present invention are explained in detail below.

In the formula, R, which may be the same or different, represents a hydrogen atom, a substituted or unsubstituted alkyl group, a substituted or unsubstituted aralkyl group or a substituted or unsubstituted aryl group, and n represents 0 or 1.

More precisely, R represents a hydrogen atom, or a substituted or unsubstituted alkyl group having from 1 to 20 carbon atoms (e.g., methyl, ethyl), a substituted or unsubstituted aralkyl group having from 6 to 20 carbon atoms (e.g., benzyl, phenethyl), or a substituted or unsubstituted aryl group having from 5 to 20 carbon atoms (e.g., phenyl, naphthyl, pyridyl). Examples of substituents for these groups include a sulfonic acid group, a hydroxyl group and a carboxyl group. Especially preferably, R is a hydrogen atom. n is 0 or 1, and is preferably 0.

Examples of the compounds represented by formula (A) which are used in the present invention are shown below, but the invention is not limited thereto:

$$CH_2{=}CHSO_2CH_2SO_2CH{=}CH_2 \quad (A\text{-}1)$$

$$CH_2{=}CHSO_2CH_2OCH_2SO_2CH{=}CH_2 \quad (A\text{-}2)$$

$$CH_2{=}CHSO_2\underset{\underset{CH_3}{|}}{CH}SO_2CH{=}CH_2 \quad (A\text{-}3)$$

$$CH_2{=}CHSO_2\underset{\underset{C_2H_5}{|}}{CH}SO_2CH{=}CH_2 \quad (A\text{-}4)$$

$$CH_2{=}CHSO_2CHSO_2CH{=}CH_2 \quad (A\text{-}5)$$

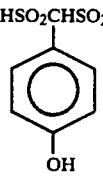

-continued $$CH_2{=}CHSO_2CHSO_2CH{=}CH_2 \quad (A\text{-}6)$$

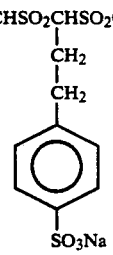

$$CH_2{=}CHSO_2CHSO_2CH{=}CH_2 \quad (A\text{-}7)$$

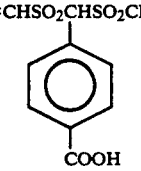

$$CH_2{=}CHSO_2CHSO_2CH{=}CH_2 \quad (A\text{-}8)$$

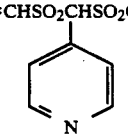

$$CH_2{=}CHSO_2CHSO_2CH{=}CH_2 \quad (A\text{-}9)$$

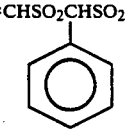

$$CH_2{=}CHSO_2CHSO_2CH{=}CH_2 \quad (A\text{-}10)$$

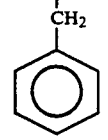

Methods of producing compounds represented by formula (A) which are used in the present invention are described in JP-B-47-24259 and JP-A-49-73122 and JP-A-63-241539.

The amount of the hardening agent represented by formula (A) to be in the photographic material of the present invention may be selected freely. In general, the hardening agent may be present in the material in an amount of preferably from 0.01 to 20% by weight, particularly preferably from 0.05 to 15% by weight, based on the dry gelatin therein.

The photographic layer to which the hardening agent of the present invention is added is not specifically limited. The agent may be added to any photographic layer (i.e., any hydrophilic colloid layer) of constituting the material, including not only silver halide emulsion layers but also light-insensitive layers (i.e. hydrophilic colloid layers), such as the subbing layer, the backing layer, the filter layer, the interlayer and the overcoat layer.

The hardening agent represented by formula (A) of the present invention may be used singly, or two or more of the agents may be used in combination. In addition, the hardening agent may be used with any other known hardening agent.

The known hardening agents which may be used along with the hardening agent of the present invention include, for example, aldehyde compounds such as formaldehyde and glutaraldehyde; ketone compounds such as diacetyl and cyclopentanedione; bis(2-chloroethylurea), 2-hydroxy-4,6-dichloro-1,3,5-triazine, and other reactive halogen-containing compounds such as those described in U.S. Pat. Nos. 3,288,775 and 2,732,303, and British Patents 974,723 and 1,167,207; 5-acetyl-1,3-diacryloylhexahydro-1,3,5-triazine and other reactive olefin compounds such as those described in U.S. Pat. Nos. 3,635,718 and 3,232,763 and British Patent 994,869; N-hydroxymethylphthalimide and other N-methylol compounds such as those described in U.S. Pat. Nos. 2,732,316 and 2,586,168; isocyanates described in U.S. Pat. No. 3,103,437; aziridine compounds described in U.S. Pat. Nos. 3,017,280 and 2,983,611; acid derivatives described in U.S. Pat. Nos. 2,725,294 and 2,725,295; epoxy compounds described in U.S. Pat. No. 3,091,537; and halogenocarboxyaldehydes such as mucochloric acid. As inorganic hardening agents, also suitable are chromium alum and zirconium sulfate. In place of the above-mentioned compounds, precursors thereof, such as alkali metal bisulfite-aldehyde adducts, methylol derivatives of hydantoin, primary aliphatic nitroalcohols, mesyloxyethylsulfonyl compounds and chloroethylsulfonyl compounds, may also be used along with the hardening agent of the present invention.

Where the hardening agent of the present invention is used in the photographic material along with other hardening agents, the proportion of the former may vary in accordance with the object and the effect and is preferably 50 mol % or more based on all the hardening agents in the material.

The hardening agent of the present invention may also be combined with a compound which is capable of accelerating hardening of gelatin. For instance, the hardening agent of the present invention may be used together with a sulfinic acid group-containing polymer as described in JP-A-56-4141, as a hardening accelerator.

Gelatin to which the hardening agent of the present invention is applied may be any of a so-called alkali-processed (lime-processed) gelatin, which is dipped in an alkaline bath before extraction of gelatin during the process of producing it, a so-called acid-processed gelatin to be dipped in an acid bath before the same, and a double-dipped gelatin processed-by both treatments; and an enzyme-processed gelatin. In addition, the hardening agent of the present invention may also be applied to a partially hydrolyzed low-molecular gelatin obtained by heating any of the above-mentioned gelatins in a water bath or by treating it with a protease.

The hydrazine derivatives which are used as a nucleating agent in the present invention are preferably compounds represented by formula (I):

$$R_{11}-\underset{\underset{A_{11}}{|}}{N}-\underset{\underset{A_{12}}{|}}{N}-G_{11}-R_{12} \qquad (I)$$

wherein $R_{11}$ represents an aliphatic group or an aromatic group; $R_{12}$ represents a hydrogen atom, an alkyl group, an aryl group, an alkoxy group, an aryloxy group, an amino group or a hydrazine group; $G_{11}$ represents —CO—, —$SO_2$—, —SO—, —P(O)$R_{13}$—, —CO-CO—, a thiocarbonyl group or an iminomethylene group; both $A_{11}$ and $A_{12}$ are hydrogen atoms or one of them is a hydrogen atom and the other is a substituted or unsubstituted alkylsulfonyl group, or a substituted or unsubstituted arylsulfonyl group, or a substituted or unsubstituted acyl group; and $R_{13}$ is selected from the groups represented by $R_{12}$ and may be different from $R_{12}$.

In the formula (I), the aliphatic group of $R_{11}$ is preferably one having from 1 to 30 carbon atoms, especially preferably a linear, branched or cyclic alkyl group having from 1 to 20 carbon atoms. The alkyl group may optionally be substituted.

In the formula (I), the aromatic group of $R_{11}$ is preferably a monocyclic or bicyclic aryl group or an unsaturated heterocyclic group. The unsaturated heterocyclic group may optionally be condensed with an aryl group to form a condensed ring.

$R_{11}$ is preferably an aryl group, especially preferably one containing a benzene ring(s).

The aliphatic or aromatic group represented by $R_{11}$ may optionally be substituted. Specific examples of substituents include an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or aryl-thio group, an alkyl- or aryl-sulfonyl group, an alkyl- or aryl-sulfinyl group, a hydroxyl group, a halogen atom, a cyano group, a sulfo group, an aryloxycarbonyl group, an acyl group, an alkoxy-carbonyl group, an acyloxy group, a carbonamide group, a sulfonamide group, a carboxyl group, a phosphoric acid amide group, a diacylamino group, an imido group, and $R_{14}$—NHCO—N($R_{15}$)—CO (wherein $R_{14}$ and $R_{15}$ may be the same or different and each is selected from the groups defined for $R_{12}$). Of them, preferred are an alkyl group (preferably having from 1 to 20 carbon atoms), an aralkyl group (preferably having from 7 to 30 carbon atoms), an alkoxy group (preferably having from 1 to 20 carbon atoms), a substituted amino group (preferably an amino group substituted by alkyl group(s) each having from 1 to 20 carbon atoms), an acylamino group (preferably having from 2 to 30 carbon atoms), a sulfonamide group (preferably having from 1 to 30 carbon atoms), a ureido group (preferably having from 1 to 30 carbon atoms), and a phosphoric acid amide group (preferably having from 1 to 30 carbon atoms). These substituent groups may optionally be substituted.

In the formula (I), the alkyl group represented by $R_{12}$ is preferably an alkyl group having from 1 to 4 carbon atoms; and the aryl group represented by $R_{12}$ is preferably a monocyclic or bicyclic aryl group (for example, one containing a benzene ring(s)).

Where $G_{11}$ is —CO—, $R_{12}$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl), or an aryl group (e.g., phenyl, 3,5-dichlorophenyl, o-methanesulfonamidophenyl, 4-methanesulfonylphenyl, 2-hydroxymethylphenyl), and is especially preferably a hydrogen atom.

$R_{12}$ may optionally be substituted. Examples of the substituents applicable to it include those defined for $R_{11}$.

In the formula (I), $G_{11}$ is most preferably —CO—.

$R_{12}$ may be a group that cleaves the moiety of —$G_{11}$—$R_{12}$ from the remaining part of the molecule to cause the formation of a cyclic structure containing the atoms of the —$G_{11}$—$R_{12}$ moiety. Examples of the groups of the type include those described in JP-A-63-29751.

$A_{11}$ and $A_{12}$ both are most preferably hydrogen atoms.

In the formula (I), $R_{11}$ or $R_{12}$ may contain therein a ballast group or a polymer which is ordinarily used in passive photographic additives such as couplers. The ballast group is one which is relatively inactive to photographic properties and has 8 or more carbon atoms. It includes, for example, an alkyl group, an alkoxy group, a phenyl group, an alkylphenyl group, a phenoxy group and an alkylphenoxy group. Examples of the polymer include those described in JP-A-1-100530.

In formula (I), $R_{11}$ or $R_{12}$ may contain therein a group which enhances adsorption of the compound to the surfaces capable of silver halide grains. Example of adsorbing group includes, for example, thiourea groups, heterocyclic thioamido groups, mercapto-heterocyclic groups, triazole groups and the like, as described in U.S. Pat. Nos. 4,385,108 and 4,459,347, and JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

Specific examples of compounds (i.e., hydrazine compounds) represented by formula (I) are shown below, but the invention is not limited thereto:

(I-1)

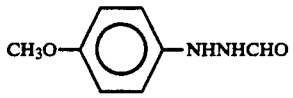

(I-2)

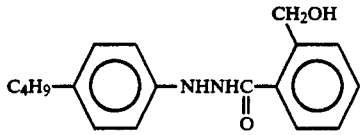

(I-3)

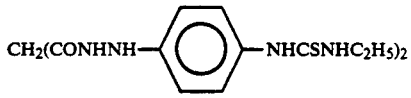

(I-4)

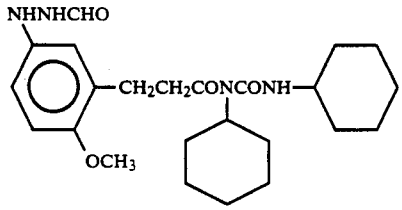

(I-5)

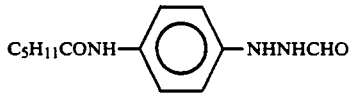

(I-6)

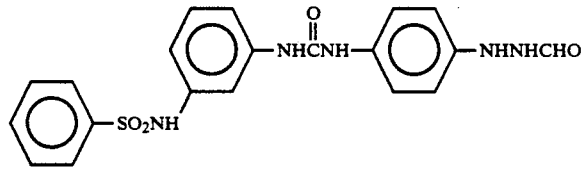

(I-7)

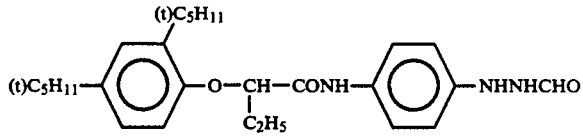

(I-8)

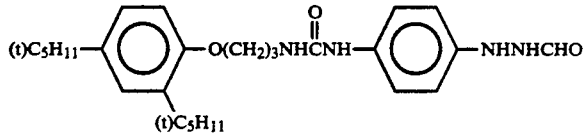

(I-9)

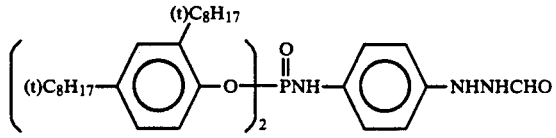

-continued
(I-10)
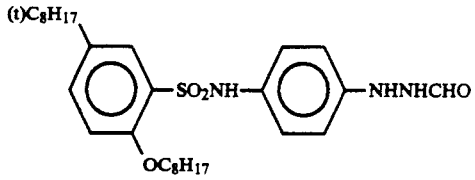
(I-11)
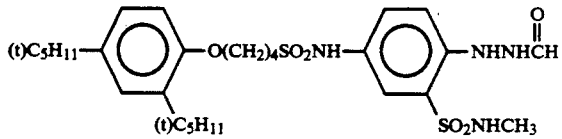
(I-12)
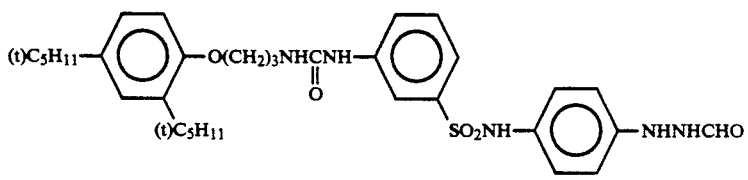
(I-13)
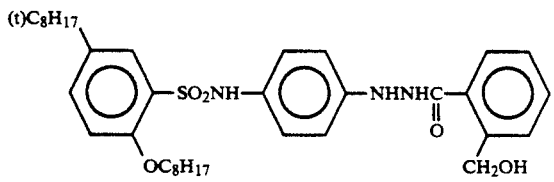
(I-14)
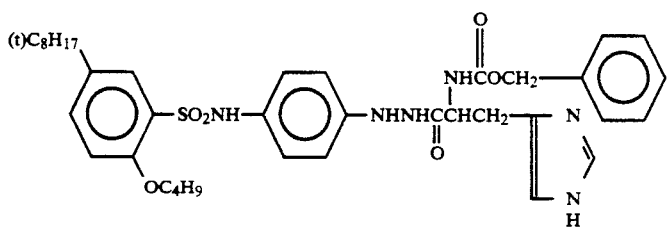
(I-15)
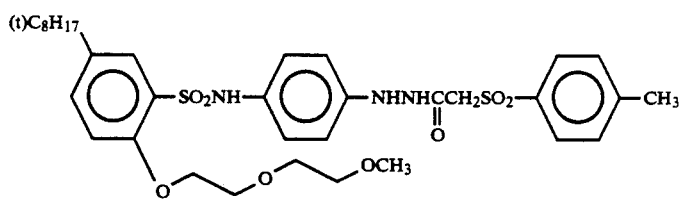
(I-16)
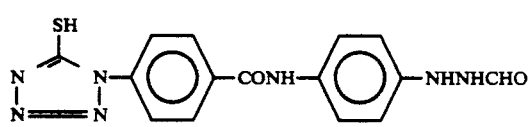
(I-17)
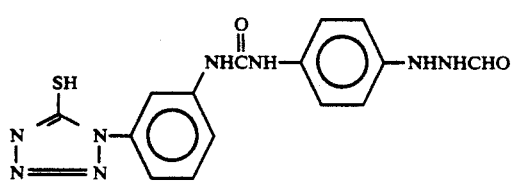

-continued
(I-18)
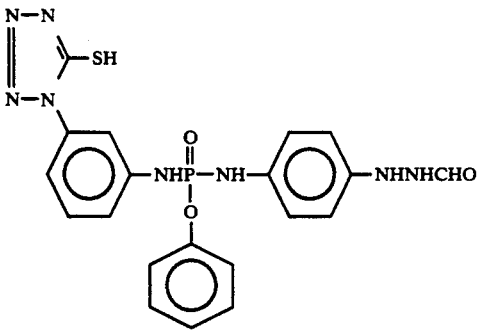
(I-19)
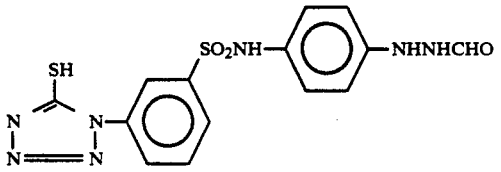
(I-20)
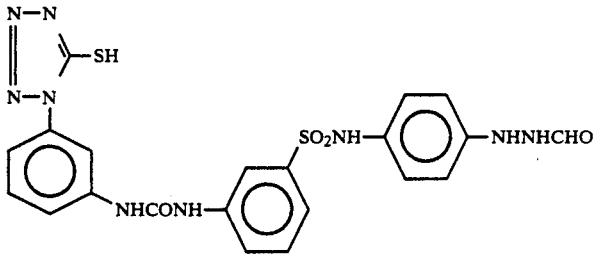
(I-21)
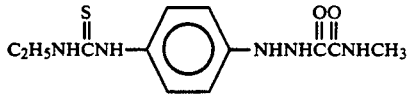
(I-22)
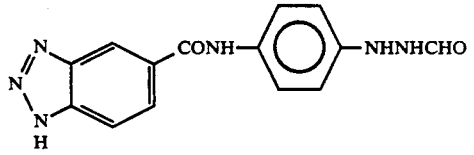
(I-23)
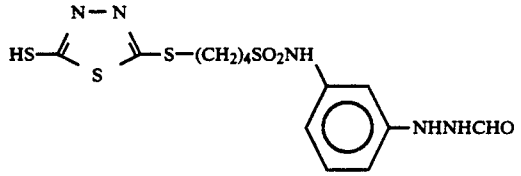
(I-24)
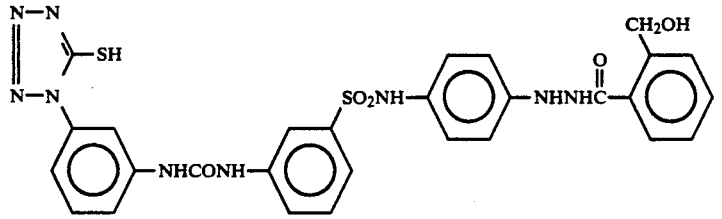

-continued (I-25)

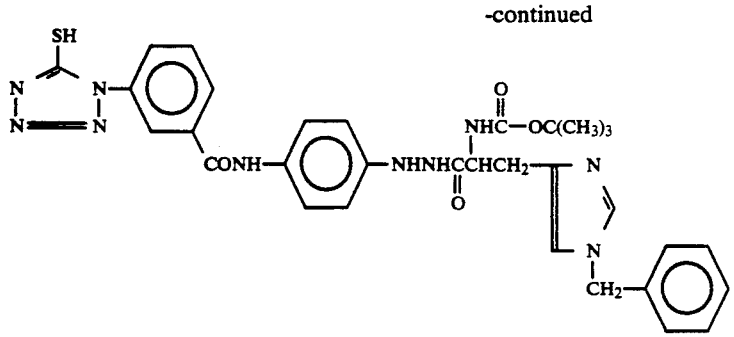

(I-26)

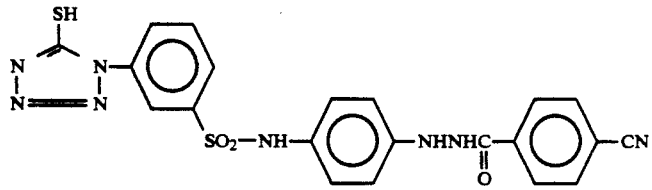

Hydrazine derivatives other than those mentioned above which are used as a nucleating agent in the present invention, include those described in RESEARCH DISCLOSURE Item 23516 (November, 1983, page 346) and the literature references referred to therein, as well as in U.S. Pat. Nos. 4,080,207, 4,269,929, 4,276,364, 4,278,748, 4,385,108, 4,459,347, 4,560,638, 4,478,928, British Patent 2,011,391B, JP-A-60-179734, JP-A-62-270948, JP-A-63-29751, JP-A-61-170733, JP-A-61-270744, JP-A-62-270948, European Patents 217,310, 356,898, U.S. Pat. No. 4,686,167, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-280747, JP-A-1-283548, JP-A-1-283549, JP-A-1-285940, JP-A-2-2541, JP-A-2-139538, JP-A-2-77057, JP-A-2-198440, JP-A-2-198441, JP-A-2-198442, JP-A-2-196234, JP-A-2-196235, JP-A-2-220042, JP-A-2-221953, JP-A-2-221954, JP-A-2-302750 and JP-A-2-304550.

The amount of the hydrazine derivative to be added to the photographic material of the present invention as a nucleating agent is preferably from $1\times10^{-6}$ mol to $5\times10^{-2}$ mol, especially preferably from $1\times10^{-5}$ mol to $2\times10^{-2}$ mol, per mol of silver halide in the photographic material.

The hydrazine derivative can be added to at least one of the emulsion layer or the other hydrophilic colloid layer and preferably the emulsion layer.

The redox compounds capable of releasing a development inhibitor by oxidation, which may be in the photographic material of the present invention, are described in detail below.

The redox group in redox compounds is preferably a group derived from preferably hydroquinones, catechols, naphthohydroquinones aminophenols, pyrazolidones, hydrazines, hydroxylamines and reductones, and more preferably, hydrazines.

Hydrazine derivatives which may be used in the present invention as redox compounds which are capable of releasing a development inhibitor by oxidation are preferably compounds represented by formula (R-1), (R-2) or (R-3). Compounds represented by formula (R-1) are especially preferred among them.

(R-1)

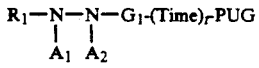

(R-2)

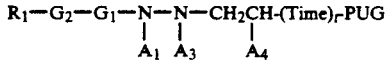

(R-3)

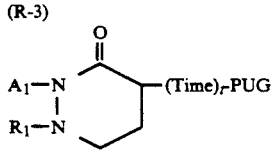

In these formulae, $R_1$ represents an aliphatic group or an aromatic group. $G_1$ represents —CO—, —CO—CO—, —CS—, —C(=N—$G_2$—$R_2$)—, —SO—, —$SO_2$— or —P(O)($G_2$—$R_2$)—. $G_2$ represents a mere chemical bond or represents —O—, —S— or —$NR_2$—, and $R_2$ represents a hydrogen atom or a group defined for $R_1$.

$A_1$ and $A_2$ each represents a hydrogen atom, an alkylsulfonyl group, an arylsulfonyl group or an acyl group, which may be or not be substituted. In the formula (R-1), at least one of $A_1$ and $A_2$ must be a hydrogen atom. $A_3$ has the same meaning as $A_1$ or represents —$CH_2$—C($A_4$)H—(Time)$_t$-PUG.

$A_4$ represents a nitro group, a cyano group, a carboxyl group, a sulfo group or —$G_1$—$G_2$—$R_1$.

Time represents a divalent linking group; and t represents 0 or 1. PUG represents a development inhibitor.

Formulae (R-1), (R-2) and (R-3) are described in more detail below.

In the formulae (R-1), (R-2) and (R-3), the aliphatic group represented by $R_1$ is preferably a group having from 1 to 30 carbon atoms, especially preferably, a linear, branched or cyclic alkyl group having from 1 to 20 carbon atoms. The alkyl group may optionally be substituted. The example of the substituents for the alkyl group include the substituents for the aryl group or unsubstituted heterocyclic group described below.

In the formulae (R-1), (R-2) and (R-3), the aromatic group represented by $R_1$ is preferably a monocyclic or dicyclic aryl group or an unsaturated heterocyclic group. The unsaturated heterocyclic group may optionally be condensed with one or more aryl groups to form a heteroaryl group.

For instance, the aryl group may be composed of a benzene ring, a naphthalene ring, a pyridine ring, a quinoline ring and/or an isoquinoline ring. Among these, the aryl group containing a benzene ring is preferred.

$R_1$ is especially preferably an aryl group.

The aryl group or unsaturated heterocyclic group represented by $R_1$ may optionally be substituted. Typical examples of the substituents include, for example, an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkylthio group, an arylthio group, a sulfonyl group, a sulfinyl group, a hydroxyl group, a halogen atom, a cyano group, a sulfo group, an aryloxycarbonyl group, an acyl group, an alkoxycarbonyl group, an acyloxy group, a carbonamide group, a sulfonamide group, a carboxyl group, and a phosphoric acid amide group. Above all, preferred as substituents are a linear, branched or cyclic alkyl group (preferably having from 1 to 20 carbon atoms), an aralkyl group (preferably having from 7 to 30 carbon atoms), an alkoxy group (preferably having from 1 or 30 carbon atoms), a substituted amino group (preferably an amino group as substituted by one or more alkyl groups having from 1 to 30 carbon atoms), an acylamino group (preferably having from 2 to 40 carbon atoms), a sulfonamide group (preferably having from 1 to 40 carbon atoms), an ureido group (preferably having from 1 to 40 carbon atoms), and a phosphoric acid amide group (preferably having from 1 to 40 carbon atoms).

$G_1$ in the formulae (R-1), (R-2) and (R-3) is preferably —CO— or —$SO_2$—, and most preferably, —CO—.

$A_1$ and $A_2$ are preferably hydrogen atoms; and $A_3$ is preferably a hydrogen atom or —$CH_2$—$CH(A_4)$—(-Time)$_t$—PUG.

In the formulae (R-1), (R-2) and (R-3), Time represents a divalent linking group, which may have a timing-adjusting function.

The divalent linking group represented by Time means a group which is capable of releasing PUG from the moiety Time-PUG to be released from the oxidation product of the redox nucleus, by a one step reaction or via a reaction comprising a plurality of steps.

Examples of the divalent linking group represented by Time include p-nitrophenoxy derivatives capable of releasing PUG by an intramolecular ring-closure reaction described in U.S. Pat. No. 4,248,962 (JP-A-54-145135); compounds capable of releasing PUG by a ring-cleavage reaction followed by an intramolecular ring-closure reaction described in U.S. Pat. No. 4,310,612 (JP A-55-53330) and U.S. Pat. No. 4,358,252; succinic acid monoesters or analogues thereof capable of releasing PUG by an intramolecular ring-closure reaction of the carboxyl group along with the formation of an acid anhydride, described in U.S. Pat. Nos. 4,330,617, 4,446,216 and 4,483,919 and JP-A-59-121328; compounds capable of releasing PUG by electron transfer of the aryloxy or heterocyclic-oxy group via the conjugated double bond to form a quinomonomethane or an analogue thereof, as described in U.S. Pat. Nos. 4,409,323, 4,421,845, RESEARCH DISCLOSURE Item No. 21,228 (December, 1981), U.S. Pat. No. 4,416,977, (JP-A-57-135944) and JP-A-58-209736 and 58-209738; compounds capable of releasing PUG by electron transfer of the enamine structure moiety of the nitrogen-containing hetero ring from the gamma-position of the enamine, as described in U.S. Pat. No. 4,420,554, (JP-A-57-136640), JP-A-57-135945, JP-A-7-5188035, JP-A-58-98728 and JP-A-58-209737; compounds capable of releasing PUG by an intramolecular ring-closure reaction of the hydroxyl group as formed by electron transfer of the carbonyl group conjugated with the nitrogen atom of the nitrogen-containing hetero ring, as described in JP-A-57-56837; compounds capable of releasing PUG with the formation of aldehydes as described in U.S. Pat. No. 4,146,396 (JP-A-52-90932), JP-A-59-93442, JP-A-59-75475, JP-A-60-249148 and JP-A-60-249149; compounds capable of releasing PUG with the decarbonylation of the carboxyl group, as described in JP-A-51-146828, JP-A-57-179842 and JP-A-59-104641; compounds having —O—$COOCR_aR_b$—PUG (wherein $R_a$ and $R_b$ each represent a monovalent group) and releasing PUG by decarbonylation followed by formation of aldehydes; compounds capable of releasing PUG with the formation of isocyanates, as described in JP-A-60-7429; and compounds capable of releasing PUG by a coupling reaction with the oxidation product of a color developing agent, as described in U.S. Pat. No. 4,438,193.

Examples of the divalent linking groups represented by Time include also described in JP-A-61-236549 and JP-A-1-269936.

PUG represents a group having a development-inhibiting effect as (Time)$_t$-PUG or as PUG.

The development inhibitor represented by PUG or (Time)$_t$-PUG may be a known development inhibitor containing hetero atoms, and it is bonded to the formula via such a hetero atom. Examples of such a development inhibitor are described, for example, in C. E. K. Mees and T. H. James, *The Theory of Photographic Processes*, 3rd Ed. (published by Macmillan Co., 1966), pages 344 to 346.

The development inhibitor represented by PUG may optionally be substituted. Examples of the substituents include those mentioned as substituents for the group $R_1$ described above. The substituents may further be substituted by the substituents.

Preferred substituents are a nitro group, a sulfo group, a carboxyl group, a sulfamoyl group, a phosphono group, a phosphinico group and a sulfonamide group.

In the formulae (R-1), (R-2) and (R-3), $R_1$ or —(-Time)$_t$—PUG may have a ballast group which is generally used with passive photographic additives such as couplers or may also have a group which accelerates adsorption of the compound represented by formula (R-1), (R-2) or (R-3) to silver halides, if desired.

The ballast group suitable for this purpose is an organic group which may give a sufficient molecular weight to the compound represented by formula (R-1), (R-2) or (R-3) so that the compound could not substantially diffuse to the other layers or to the processing solutions. It is composed of one or more of an alkyl group, an aryl group, a heterocyclic group, an ether group, a thioether group, an amide group, an ureido group, an urethane group and a sulfonamide group. Preferably, the ballast group is a substituted benzene ring-containing ballast group, especially a branched alkyl group-substituted benzene ring-containing ballast group.

Examples of the groups having the function of accelerating adsorption of the compound represented by formula (R-1), (R-2) or (R-3) to silver halides include, for example, cyclic thioamido groups such as 4-thiaozline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine and 1,3-imidaozline-2-thione; linear thioamide groups; aliphatic mercapto groups; aromatic mercapto groups; heterocyclic mercapto groups (when a nitrogen atom is adjacent to the carbon atom bonded to —SH, the groups have the same meaning as the cyclic thioamide groups which are tautomers of the groups, and specific examples of the groups are the same as those mentioned above); disulfido bond-containing groups, 5-membered or 6-membered nitrogen-containing heterocyclic groups composed of a combination of nitrogen, oxygen, sulfur and carbon atoms, such as benzotriazoles, triazoles, tetrazoles, indazoles, benzimidazoles, imidazoles, benzothiazoles, thiazoles, thiazolines, benzoxazolines, oxazoles, oxazolines, thiadiazoles, oxathiazoles, triazines, azaindenes; as well as heterocyclic quaternary salts such as benzimidazoliums.

These groups may further be substituted by suitable substituent(s), if desired.

Examples of the substituents include those mentioned for the group $R_1$ as above.

Specific examples of the redox compounds of the above-mentioned formulae which are employable in the present invention are shown below, but the invention is not limited thereto:

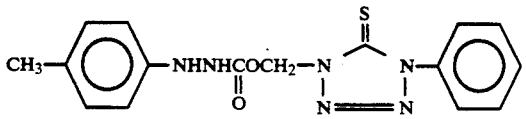
(II-1)

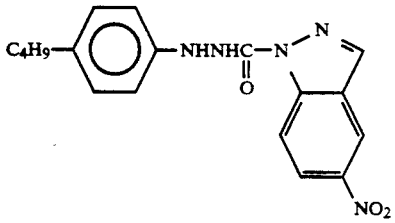
(II-2)

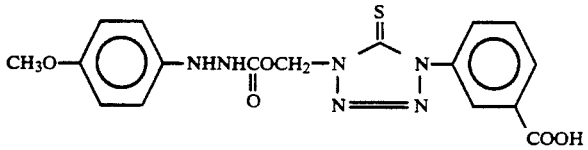
(II-3)

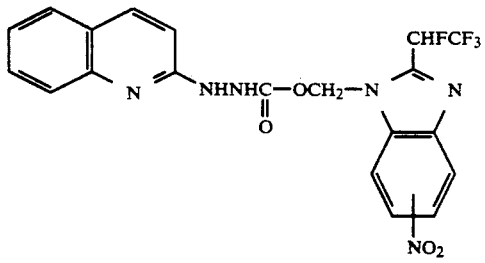
(II-4)

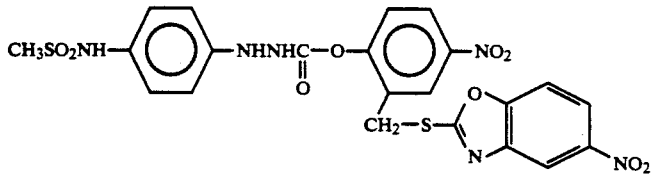
(II-5)

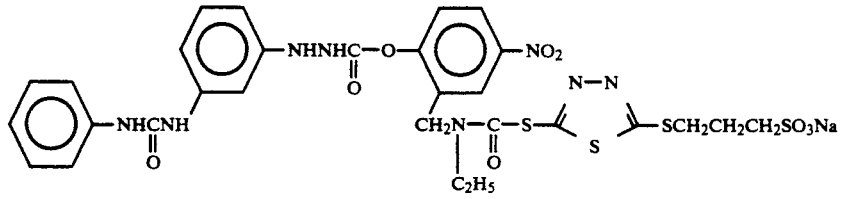
(II-6)

-continued
(II-7)
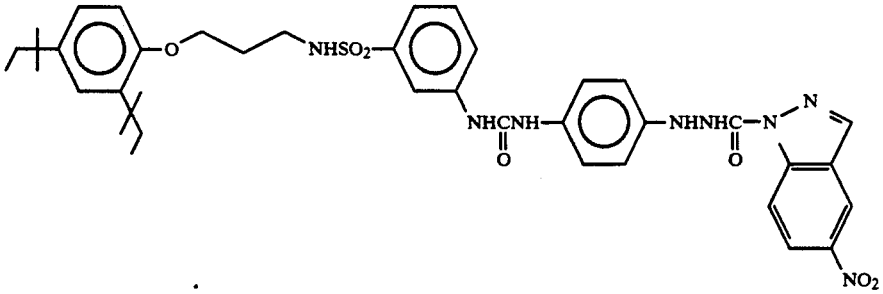
(II-8)
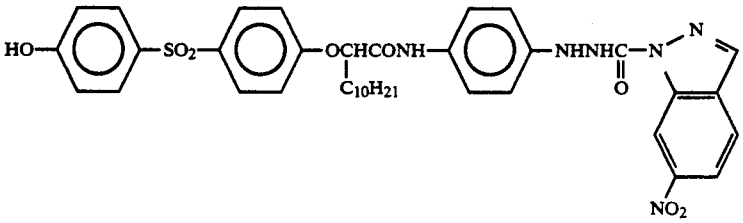
(II-9)
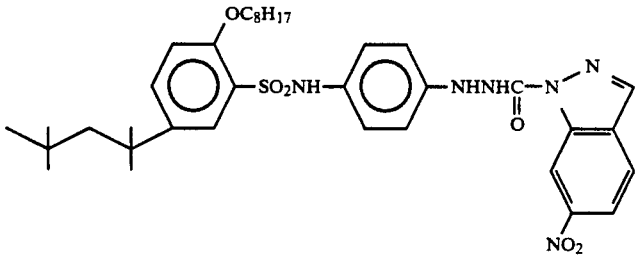
(II-10)
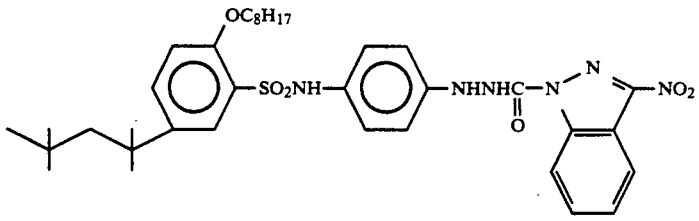
(II-11)
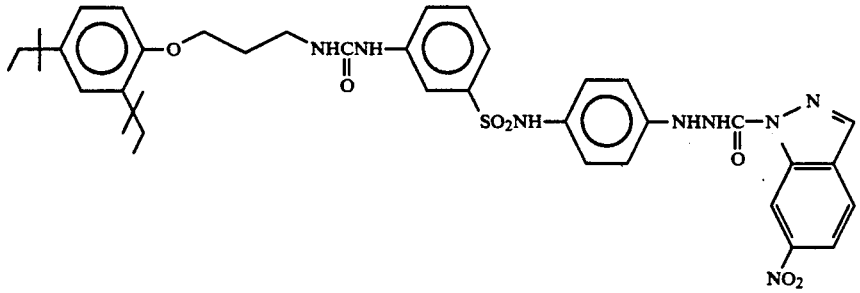
(II-12)
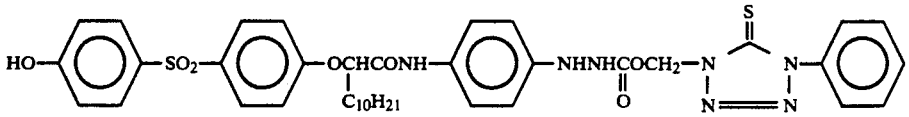

-continued
(II-13)
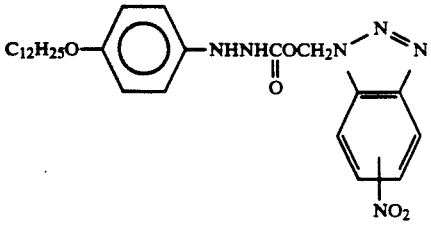
(II-14)
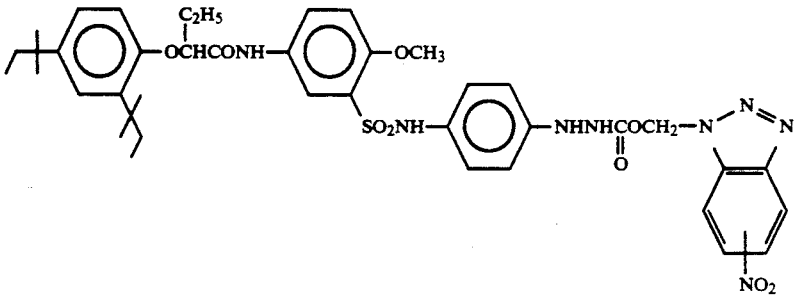
(II-15)
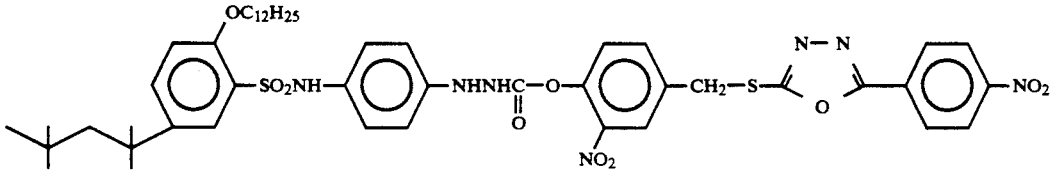
(II-16)
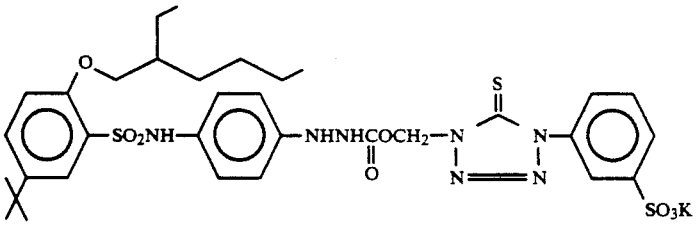
(II-17)
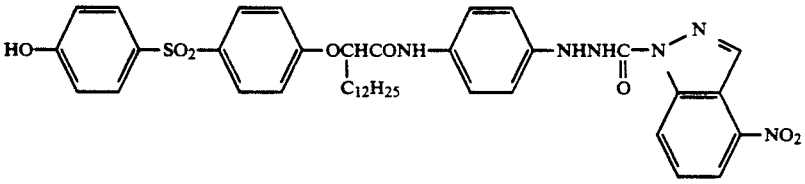
(II-18)
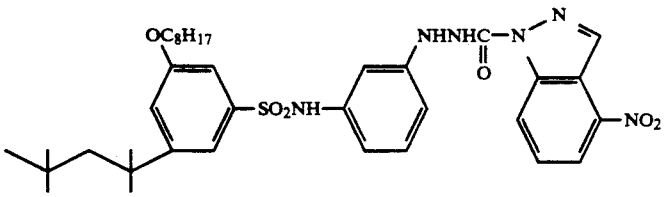
(II-19)
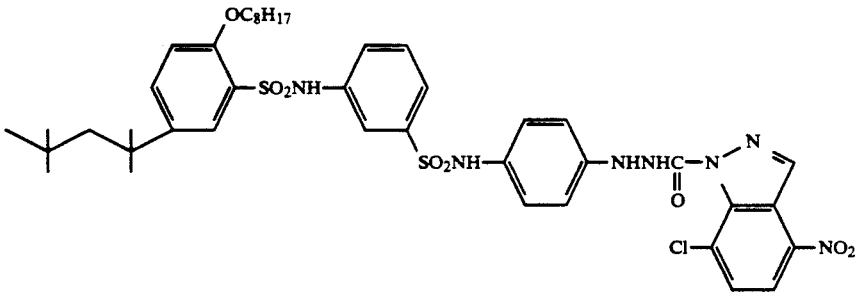

-continued
(II-20)
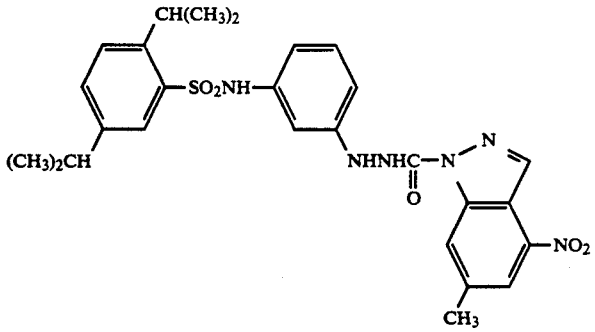
(II-21)
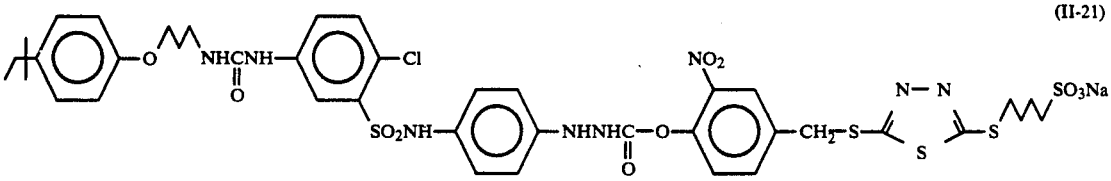
(II-22)
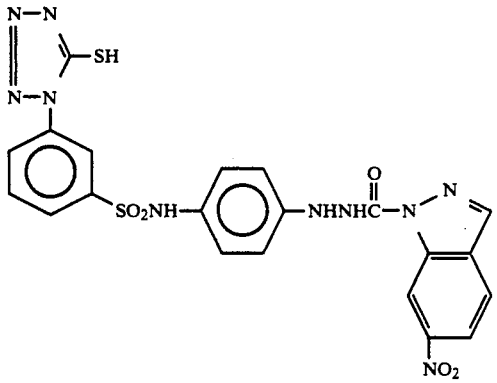
(II-23)
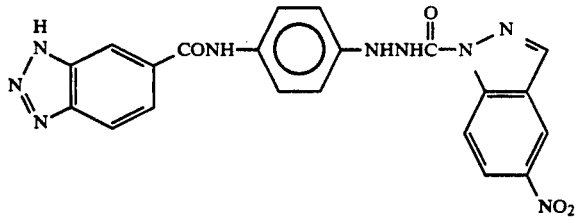
(II-24)
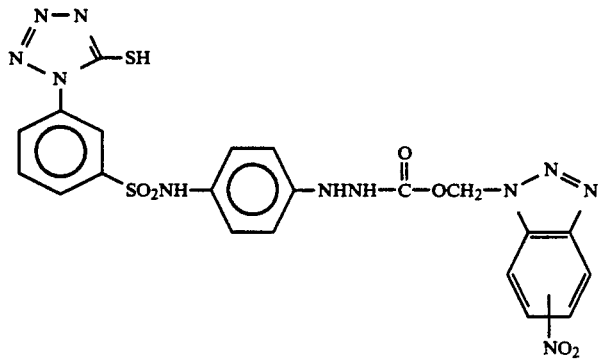

-continued (II-25)

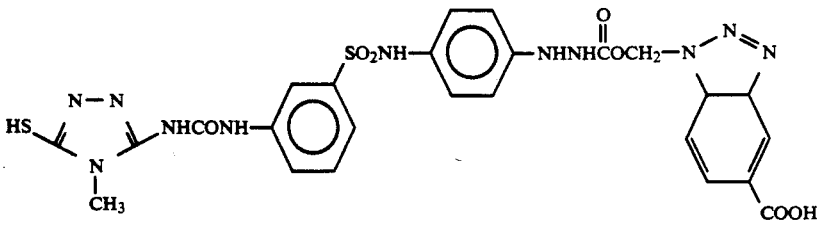

(II-26)

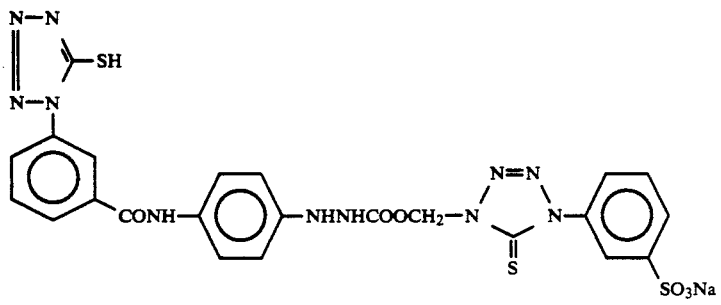

(II-27)

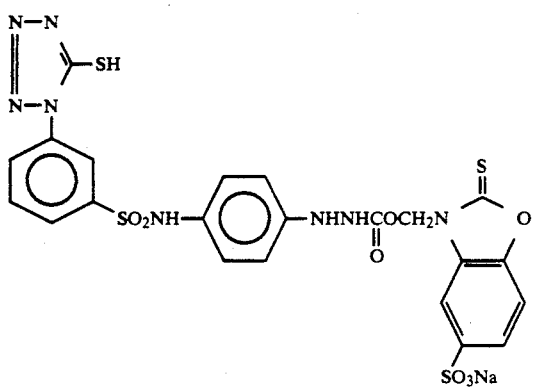

(II-28)

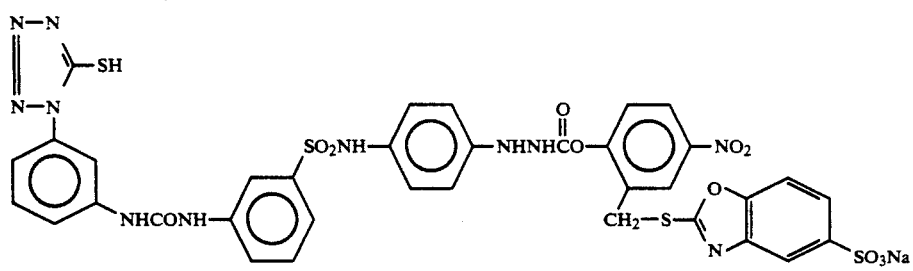

The redox compounds suitable in the present invention also include those described in JP-A-61-213847, JP-A-62-260153, European Patent Application Nos. 393711A, 373721A, U.S. Pat. No. 5,134,055 and JP-A-3-67246.

Methods of preparing the redox compounds suitable in the present invention are described, for example, in JP-A-61-213847, JP-A-62-260153, JP-A-1-269936, U.S. Pat. Nos. 4,684,604, 3,379,529, 3,620,746, 4,377,634, 4,332,878, JP-A-49-129536, JP-A-56-153336, JP-A-56-153342.

The amount of the redox compound(s) contained in the photographic material of the present invention may be from $1\times10^{-6}$ to $5\times10^{-2}$ mol, more preferably from $1\times10^{-5}$ to $1\times10^{-2}$ mol, per mol of silver halide in the material.

For incorporating the redox compound into the photographic material of the present invention, it may be dissolved in a suitable water-miscible organic solvent, for example, alcohols (e.g., methanol, ethanol, propanol, fluorinated alcohols), ketones (e.g., acetone, methyl ethyl ketone), dimethylformamide, dimethylsulfoxide, or methyl cellosolve.

As another means, the compound may be mechanically formed into an emulsified dispersion by means of a well known emulsifying and dispersing method using an oil such as dibutyl phthalate, tricresyl phosphate, glyceryl triacetate or diethyl phthalate and an auxiliary solvent such as ethyl acetate or cyclohexanone. As still another means, a powder of the redox compound may be dispersed in water by a ball mill or colloid mill or by the action of ultrasonic waves, according to a well-known solid dispersing method (i.e., a method dispersing the powder of the redox compound in the form of fine solid particles).

The redox compound of the present invention is added to at least one of the emulsion layer or the hydrophilic colloid layer, and preferably to a layer containing no hydrazine nucleating agent.

Silver halides constituting the photographic material of the present invention are preferably in the form of monodispersed silver halide emulsions. The emulsions are not specifically limited with respect to the halogen composition. Preferably, the halogen composition of the emulsions is desired to have a silver chloride content of 50 mol % or more; and either silver chlorobromide or silver iodochlorobromide is desired, in which the silver iodide content is preferably 3 mol % or less, more preferably 0.5 mol % or less.

For preparing monodispersed silver halide emulsions for use in the present invention, various methods which are well known in this technical field can be employed. For instance, methods described in P. Glafkides, *Chimie et Physique Photographique* (published by Paul Montel, 1967); G. F. Duffin, *Photographic Emulsion Chemistry* (published by The Focal Press, 1966); V. L. Zelikman et al., *Making and Coating Photographic Emulsion* (published by The Focal Press, 1964) can be employed.

The monodispersed silver halide emulsions for use in the present invention are desired to have a fluctuation coefficient of 20% or less, especially preferably 15% or less with respect to grain size of silver halide gains.

The fluctuation coefficient is defined by the following formula:

$$\textit{Fluctuation Coefficient}\ (\%) = [(\textit{Standard Deviation of Grain Size})/(\textit{Mean Grain Size})] \times 100$$

Grains constituting monodispersed silver halide emulsions for use in the present invention have a mean grain size of preferably 0.5 μm or less, especially preferably from 0.1 μm to 0.4 μm.

Silver halide grains constituting the photographic materials of the present invention may be formed by a method of reacting a water-soluble silver salt (e.g., in the form of an aqueous silver nitrate solution) and water-soluble halide(s). For effecting the method, any of a single jet method, a double jet method or a combination thereof can be employed. As one example of a double jet method, a so-called controlled double jet method is suitable, in which the pAg value of the aqueous phase for forming silver halide grains is kept constant throughout the reaction. Use of a so-called silver halide solvent such as ammonia, thioether or tetra-substituted thioureas in the step for forming silver halide grains is preferred.

More preferably, tetra-substituted thiourea compounds are used, which are described in JP-A-53-83408 and JP-A-55-77737. Preferred thiourea compounds for the purpose are tetramethylthiourea and 1,3-dimehtyl-2-imidazolidinethione.

By a controlled double jet method or a method of using a silver halide solvent, it is easy to produce silver halide grains having a regular crystalline form and having a narrow grain size distribution. Accordingly, the two methods are advantageous for forming emulsions to be used in the present invention.

The silver halide grains in the monodispersed emulsions for use in the present invention are desired to have a regular crystalline form, such as a cubic, octahedral or tetradecahedral crystalline form. Especially preferred is a cubic crystalline form.

The silver halide grains for use in the present invention may be either ones having a uniform phase in the inside and the surface parts or ones having different phases in those parts.

Spectral sensitizing dyes which are preferably used in the photographic material of the present invention are compounds represented by formula (S):

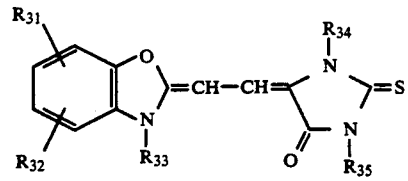

(S)

wherein $R_{31}$ and $R_{32}$ each represents a hydrogen atom, a halogen atom, a substituted or unsubstituted alkyl group having from 1 to 8 carbon atoms, a hydroxyl group, an alkoxy group, a phenyl group, a naphthyl group, a sulfo group or a carboxyl group, and $R_{31}$ and $R_{32}$ may be bonded to each other to form a 6-membered ring;

$R_{33}$ represents a substituted or unsubstituted an alkyl group having from 1 to 8 carbon atoms or an alkenyl group;

$R_{34}$ represents a hydrogen atom or a substituted or unsubstituted alkyl group having from 1 to 12 carbon atoms;

$R_{35}$ represents a pyridyl group optionally substituted by at least one substituent selected from the group consisting of a halogen atom, a lower alkyl group, a hydroxyl group, a hydroxyalkyl group, an alkoxy group, a sulfo group and a carboxyl group.

Compounds represented by formula (S) of the present invention are described in more detail hereunder.

In the formula, $R_{31}$ and $R_{32}$ each represents a hydrogen atom, a halogen atom (e.g., chlorine, bromine), a substituted or unsubstituted alkyl group preferably having from 1 to 8 carbon atoms (e.g., methyl, ethyl, hydroxyethyl), a substituted or unsubstituted alkoxy group preferably having from 1 to 8 carbon atoms (e.g., methoxy, ethoxy), a hydroxyl group, a phenyl group, a naphthyl group, a sulfo group or a carboxyl group; and $R_{31}$ and $R_{32}$ may be bonded to each other to form a 6-membered ring. The ring may have thereon at least one substituent selected from the group consisting of a halogen atom, a lower alkyl group, a hydroxyl group, a hydroxyalkyl group, a phenyl group, an alkoxy group and a carboxyl group.

$R_{33}$ represents a substituted or unsubstituted alkyl group (e.g., methyl, ethyl, sulfoethyl, sulfopropyl, sulfoamidoethyl, sulfobutyl), or a substituted or unsubstituted alkenyl group (e.g., allyl).

$R_{34}$ represents a substituted or unsubstituted alkyl group preferably having from 1 to 12 carbon atoms. As substituents for the group, preferred are a hydroxyl group and a carbamido group. The alkyl group may interpose —O—, —OCO—, —NH— and/or —N= between the carbon chains.

$R_{35}$ represents a pyridyl group, which may optionally be substituted by at least one substituent selected from the group consisting of a halogen atom (e.g., chlorine, bromine), a lower alkyl group (e.g., methyl, ethyl), a hydroxyl group, a hydroxyalkyl group (e.g., hydroxyethyl), an alkoxy group (e.g,. methoxy, ethoxy), a sulfo group and a carboxyl group.

Spectral sensitizing dyes represented by formula (S) are added to the silver halide photographic material of the present invention so that the material may be a high-sensitive, super-high contrast and satisfactorily safe to a safelight. They are preferably added to at least one of the emulsion layers or the other hydrophilic colloid layers constituting the material.

The amount of the spectral sensitizing dyes added is preferably from $5\times10^{-5}$ to $5\times10^{-4}$ mol per mol of silver halide in the material.

Specific examples of compounds represented by formula (S) which are used in the present invention are shown below, but the invention is not limited thereto:

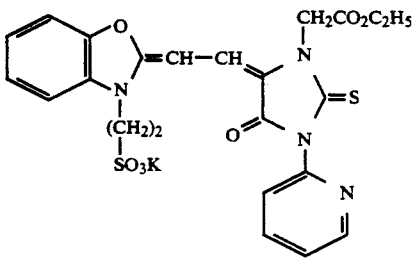
(S-1)

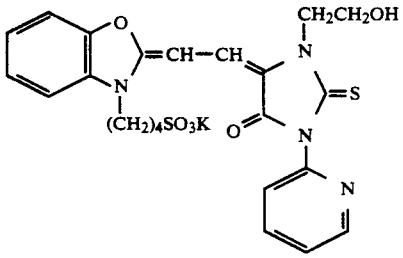
(S-2)

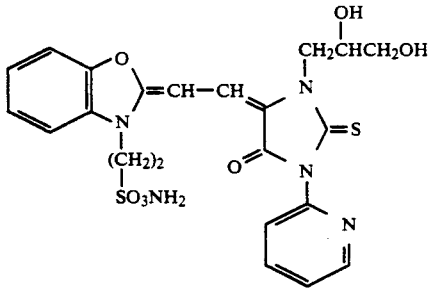
(S-3)

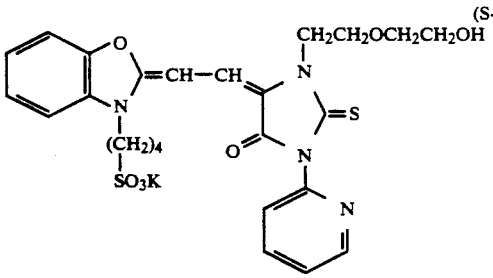
(S-4)

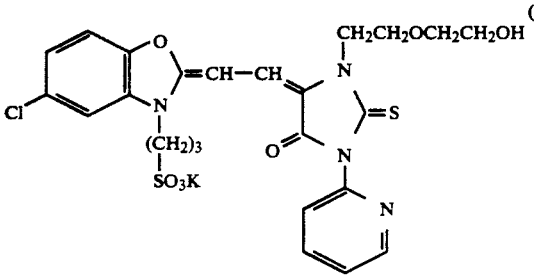
(S-5)

-continued

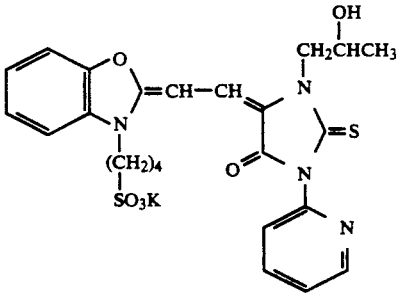
(S-6)

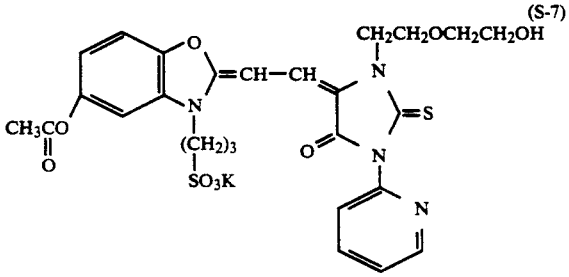
(S-7)

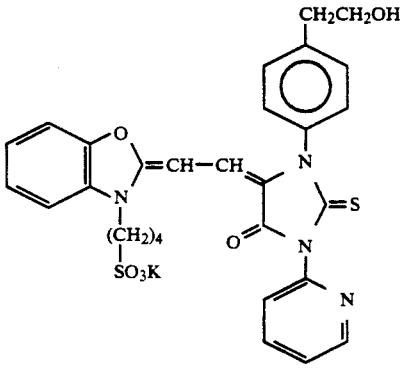
(S-8)

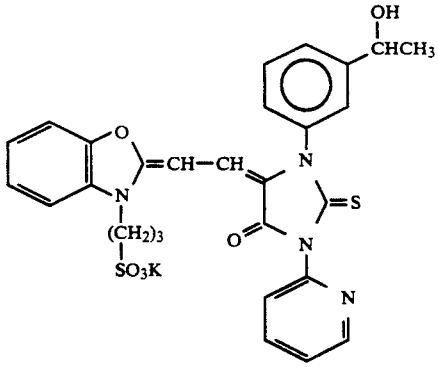
(S-9)

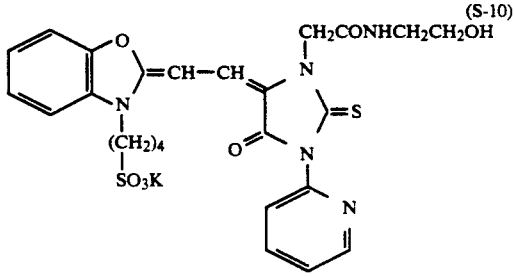
(S-10)

Dyes which are more preferably used in the photographic material of the present invention are compounds represented by formula (F):

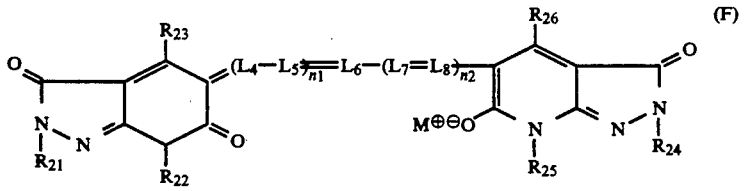

(F)

wherein $R_{21}$ and $R_{24}$ each represents a hydrogen atom, an aliphatic group, an aromatic group or a heterocyclic group;

$R_{22}$ and $R_{25}$ each represents a hydrogen atom, an aliphatic group, an aromatic group, a heterocyclic group, $—COR_{29}$ or $—SO_2R_{29}$;

$R_{23}$ and $R_{26}$ each represents a hydrogen atom, a cyano group, an alkyl group, an aryl group, $—COOR_{27}$, $—OR_{27}$, $—NR_{27}R_{28}$, $—N(R_{28})COR_{29}$, $—N(R_{28})SO_2R_{29}$, $—CONR_{27}R_{28}$, or $—N(R_{27})CONR_{27}R_{28}$, in which $R_{29}$ represents an aliphatic group or an aromatic group, and $R_{27}$ and $R_{28}$ each represents a hydrogen atom, an aliphatic group or an aromatic group;

$L_4$, $L_5$, $L_6$, $L_7$ and $L_8$ each represent a methine group;

$n_1$ and $n_2$ each represent 0 or 1;

$M^+$ represents a hydrogen atom or a monovalent cation; provided that at least one of $R_{21}$, $R_{22}$, $R_{23}$, $R_{24}$, $R_{25}$, $R_{26}$, $L_4$, $L_5$, $L_6$, $L_7$ and $L_8$ is a group having at least one of a carboxylic acid group or a sulfonic acid group.

Compounds represented by formula (F) are described in detail below.

The aliphatic group represented by $R_{21}$, $R_{22}$, $R_{23}$, $R_{24}$, $R_{25}$, $R_{26}$, $R_{27}$, $R_{28}$ and $R_{29}$ is preferably a linear, branched or cyclic alkyl group having from 1 to 8 carbon atoms, an aralkyl group having from 6 to 12 carbon atoms, or an alkenyl group having from 3 to 7 carbon atoms. Concrete examples of the aliphatic group includes, for example, a methyl group, an ethyl group, an n-butyl group, a benzyl group, a 2-sulfoethyl group, a 4-sulfobutyl group, a 2-sulfobenzyl group, a 2,4-disulfobenzyl group, a 2-carboxyethyl group, a carboxymethyl group, a 2-hydroxyethyl group, a dimethylaminoethyl group and a trifluoromethyl group.

The aromatic group represented by $R_{21}$, $R_{22}$, $R_{23}$, $R_{24}$, $R_{25}$, $R_{26}$, $R_{27}$, $R_{28}$ and $R_{29}$ is preferably an aryl group having from 6 to 10 carbon atoms. Concrete examples of the aromatic group includes, for example, a phenyl group, a naphthyl group, a 4-sulfophenyl group, a 3-sulfophenyl group, a 2-sulfophenyl group, a 2,5-disulfophenyl group, a 2,4-disulfophenyl group, a 3,5-disulfophenyl group, a 4-carboxyphenyl group, a 5,7-disulfo-3-naphthyl group, a 4-methoxyphenyl group and a p-tolyl group.

The heterocyclic group represented by $R_{21}$, $R_{23}$, $R_{24}$ and $R_{25}$ is preferably a 5-membered or 6-membered nitrogen-containing heterocyclic group (including a benzene-condensed ring). For instance, examples of the heterocyclic group includes a 5-sulfopyridin-2-yl group and a 5-sulfobenzothiazol-2-yl group.

The methine group represented by $L_4$, $L_5$, $L_6$, $L_7$ and $L_8$ may optionally be substituted by at least one substituent (e.g., methyl, ethyl, phenyl, chlorine, sulfoethyl, carboxyethyl, dimethylamino, cyano). Two or more of these substituents may be bonded to each other to form a 5-membered or 6-membered ring (e.g., cyclohexene, cyclopentene, 5,5-dimethylcyclohexene).

The monovalent cation represented by $M^+$ includes, for example, $Na^+$, $K^+$, $HN^+(C_2H_5)_3$, and $Li^+$.

The dyes represented by formula (F) which are used in the present invention each have an absorption maximum of from 600 to 700 nm, especially preferably from 610 to 660 nm.

The dyes represented by formula (F) are described in JP-A-63-316853 and JP-B-58-35544 or may be produced in accordance with the methods described therein.

The dyes represented by formula (F) may be added to the coating solutions for forming hydrophilic colloid layers constituting the photographic material of the present invention, in the form of a solution obtained by dissolving each in a suitable solvent (e.g., water, methanol, ethanol, N,N-dimethylformamide). Where they are sparingly soluble in water, they may be added to the layers in the form of a dispersion of fine solid grains.

The dispersion of fine grains of the dyes represented by formula (F) which are used in the present invention may be prepared by a method in which the dye is precipitated according to the form of a dispersion thereof and/or a method in which the dye is ground in the presence of a dispersing agent by the use of a known grinding means such as ball milling (for example, in ball mill, shaking ball mill, planet ball mill), sand milling, colloid milling, jet milling or roller milling. In the latter case, a solvent (e.g., water, alcohol) may be added to the grinding system. As another means, the dye of the present invention is first dissolved in a suitable solvent, then a weak solvent for the dye is added to the resulting solution so as to precipitate fine crystals therein. In this case, a surfactant for dispersion may be added to the system. As still another means, the dye of the present invention is first dissolved by pH control, then the pH value of the solution is varied to form fine crystals therein The fine solid grains of the dye of the present invention in a dispersion have a mean grain size of 10 μm or less, preferably 2 μm or less, especially preferably 0.5 μm or less. As the case may be, the grains are further desired to be fine grains having a mean grain size of 0.1 μm or less.

The dyes represented by formula (F) may be added to at least one of emulsion layers or other hydrophilic colloid layers constituting the photographic material of the present invention. These may be used in combination of two or more.

The amount of the dye represented by formula (F) in the photographic material of the present invention may suitably be determined in accordance with the object. Preferably, the amount of the dye represented by formula (F) is within the range of preferably from $1\times10^{-4}$ g/m$^2$ to 1 g/m$^2$, especially preferably from $1\times10^{-3}$ g/m$^2$ to 0.5 g/m$^2$. Specific examples of compounds represented by formula (F) which are used in the present invention are shown in Table A below.

TABLE A

| Dye | $R_{21}$, $R_{24}$ | $R_{22}$, $R_{25}$ | $R_{23}$, $R_{26}$ | $=(L_4-L_5)_{n1}=L_6-(L_7=L_8)_{n2}-$ | $M^{\ominus}$ |
|---|---|---|---|---|---|
| F-1 | 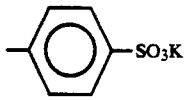 | $-CH_3$ | $-CH_3$ | $=CH-$ | H |
| F-2 | 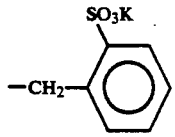 | 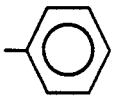 | $-COOK$ | $=CH-$ | K |
| F-3 | 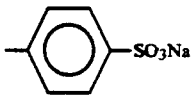 | $-H$ | $-OC_2H_5$ | $=CH-$ | H |
| F-4 | $-(CH_2)_3SO_3H$ | $-CH_2CH_2OH$ | 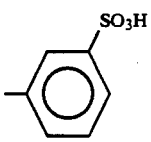 | $=CH-CH=CH-$ | H |
| F-5 | $-(CH_2)_2SO_3K$ | $-COCH_3$ | $-COOK$ | $=CH-CH=CH-$ | H |
| F-6 | 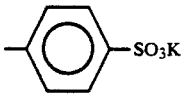 | $-CH_3$ | $-COOC_2H_5$ | $=CH-$ | K |
| F-7 | 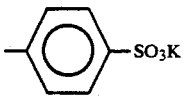 | $-CH_3$ | $-CH_3$ | $=CH-CH=CH-$ | H |
| F-8 | 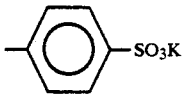 | $-H$ | $-CH_3$ | $=CH-CH=CH-$ | H |
| F-9 | 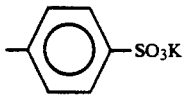 | $-CH_3$ | $-CH_3$ | $=CH-(CH=CH)_2-$ | H |
| F-10 | $-CH_2CH_2COOH$ | $-CH_2CH_2OH$ | $-COOH$ | $=CH-CH=CH-$ | H |
| F-11 | $-CH_2CH_2SO_3K$ | 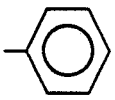 | $-CH_3$ | $=CH-CH=CH-$ | H |
| F-12 | 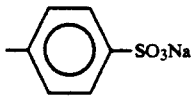 | 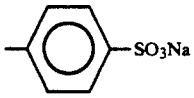 | $-CH_3$ | $=CH-CH=CH-$ | H |

Other components or additives which may be applied to the photographic material of the present invention are not specifically limited. For instance, those mentioned below are suitable.

| Additives | References |
|---|---|
| 1) Nucleation Accelerator | JP-A 2-103536, from page 9, right top column, line 13 to page 16, left top column, line 10 |
| 2) Silver Halide Emulsions and method for Producing the same | JP-A 2-97937, from page 20, right bottom column, line 12 to page 21, left bottom column, line 14; JP-A 2-12236, from page 7, right top column, line 19 to page 8, left bottom column, line 12 |
| 3) Color Sensitizing Dyes | JP-A 2-12236, from page 8, left bottom column to page 8, right bottom column, line 4; JP-A 2-103536, from page 16, right bottom column, line 3 to page 17, left bottom column, line 20 |

-continued

| Additives | References |
|---|---|
| 4) Surfactants, Antistatic Agents | JP-A 2-12236, from page 9, right top column, line 7 to page 9, left bottom column, line 7; JP-A 2-18542, from page 2, left bottom column, line 13 to page 4, right bottom column, line 18 |
| 5) Antifoggants, Stabilizers | JP-A 2-103526, from page 17, right bottom column, line 19, to page 18, right top column, line 4, and page 18, right bottom column, lines 1 to 5 |
| 6) Polymer Latexes | JP-A 2-103526, page 18, left bottom column, lines 12 to 20 |
| 7) Acid Group-Containing Compounds | JP-A 2-103526, from page 18, right bottom column, line 6 to page 19, left top column, line 1 |
| 8) Matting Agents, Lubricants, Plasticizers | JP-A 2-103526, from page 19, left top column, line 15 to page 19, right top column, line 15 |
| 9) Hardening Agents | JP-A 2-103536, page 18, right top column, lines 5 to 17 |
| 10) Dyes | JP-A 2-103536, page 17, right bottom column, lines 1 to 18 |
| 11) Binders | JP-A 2-18542, page 3, right bottom column, lines 1 to 20 |

In order to attain the objects of the present invention, it is preferred that the water content in the silver halide photographic material of the present invention is 22% or less by weight, particularly 20% by weight or less, based on the total gelatin weight therein.

The water content of a silver halide photographic material means the total weight of water contained in all the constituent layers of the silver halide emulsion layers, gelatin-containing protective layers and backing layers, and it may be measured by a heated dry weight measuring system.

The photographic material of the present invention is produced by coating a plurality of coating solutions onto a running support by various coating methods, drying the coated layers and winding the coated support around a core. Drying is effected by utilizing a sol-to-gelling phenomenon in which the support immediately after being coated is set in a cooling zone, then the temperature of the zone is gradually elevated to lead the support to being constant drying and then to reduction drying to finish the drying of the coated support. After the drying zone, the photographic material is conditioned and led to a winding chamber where it is wound around a core to a roll. In general, the winding chamber is set at an ordinary temperature (20° to 25° C.) and an ordinary humidity (40 to 60% relative humidity). Where the support is a polyethylene terephthalate film, a longer time is needed before the equilibrated water content therein is attained, since it has a lower water absorbing rate than a gelatin film. Therefore, depending upon the water content in the base support, the equilibrated water content of the material often differs from that estimated from the winding-up temperature.

For development of the photographic material of the present invention, the description of JP-A-2-103536, from page 19, right top column, line 16 to page 21, left top column, line 8 is referred to.

Next, the present invention will be explained in more detail by way of the following examples, which, however, do not restrict the scope of the present invention.

EXAMPLE 1

Emulsions were prepared in the manner shown below. Preparation of Emulsion A:

An aqueous 0.13M silver nitrate solution and an aqueous halide solution containing $1\times10^{-7}$ mol, per mol of silver, of a $K_2Rh(H_2O)Cl_5$ and $2\times10^{-7}$ mol, per mol of silver, of a $K_2IrCl_6$ and containing 0.04M potassium bromide and 0.09M sodium chloride were added to an aqueous gelatin solution containing sodium chloride and 1,3-dimethyl-2-imidazolidinethione, under stirring at 38° C. over a period of 12 minutes, by a double-jet method for nucleation to obtain silver chlorobromide grains having a mean grain size of 0.15 μm and a silver chloride content of 70 mol %. Subsequently, an aqueous 0.87M silver nitrate solution and an aqueous halide solution containing 0.26M potassium bromide and 0.65M sodium chloride were added thereto by the same double-jet method over a period of 20 minutes.

Next, $1\times10^{-3}$ mol of a KI solution was added thereto for conversion, then the emulsion was rinsed with water by a flocculation method. Forty g of gelatin was added thereto; the emulsion was adjusted to a pH of 6.5 and pAg of 7.5; 8 mg, per mol of silver, of sodium benzenesulfonate, 5 mg, per mol of silver, of sodium thiosulfate, and 8 mg, per mol of silver, of chloroauric acid were added thereto; the emulsion was heated at 60° C. for 60 minutes for chemical sensitization; and 150 mg of 4-hydroxy-6-methyl-1,3,3a,7-tetrazaindene was added thereto as a stabilizer. The grains thus formed were cubic silver chlorobromide grains having a mean grain size of 0.27 μm, a silver chloride content of 70 mol % and a fluctuation coefficient of 10%.

Emulsion A thus formed was divided into a plurality of parts. One $\times10^{-3}$ mol, per mol of silver, of a 5-{[3-(4-sulfobutyl)-5-chloro-2-benzoxazolidylidene]ethylidene}-1-hydroxyethoxyethyl-3-(2-pyridyl)-2-thiohydantoin potassium salt was added thereto as a sensitizing dye; and additionally, $2\times10^{-4}$ mol, per mol of silver, of 1-phenyl-5-mercaptotetrazole; $5\times10^{-4}$ mol, per mol of silver, of a shortwaved cyanine dye having the following structural formula (a); 200 mg/m² of a water-soluble latex represented by the following formula (b); 200 mg/m² of a polyethyl acrylate dispersion; $1\times10^{-4}$ mol, per mol of silver, of a hydrazine compound of the following formula (c); $5\times10^{-5}$ mol, per mol of silver, of a hydrazine compound of the following formula (d); and, as a gelatin hardening agent, a compound of the present invention or a comparative compound as indicated in Table 1 below were added thereto:

Compound (a):

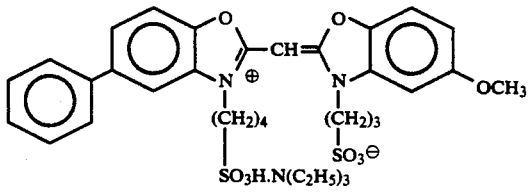

Compound (b):

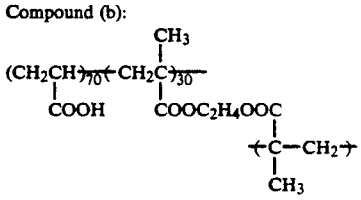

Hydrazine Compound (c):

-continued

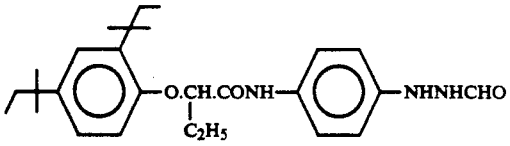

Hydrazine Compound (d):

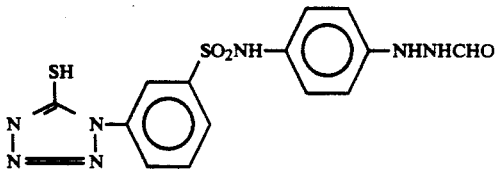

Comparative Compound (a):

$CH_2{=}CHSO_2CH_2CHCH_2SO_2CH{=}CH_2$
|
OH

Comparative Compound (b):

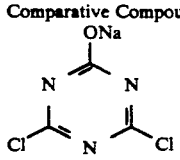

Preparation of Emulsions for a Redox Compound-Containing Layer

An aqueous 1.0M silver nitrate solution and an aqueous halide solution containing $3\times10^{-7}$ mol, per mol of silver, of $(NH_4)_3RhCl_6$ and containing 0.3M potassium bromide and 0.74M sodium chloride were added to an aqueous gelatin solution containing 1,3-dimethyl-2-imidazolidinethione, under stirring at 45° C. over a period of 30 minutes, by a double jet method, to form silver chlorobromide grains having a mean grain size of 0.28 μm and a silver chloride content of 70 mol %. Afterwards, the emulsion was washed with water by a flocculation method; 40 g of gelatin was added thereto; the emulsion was adjusted to a pH of 6.5 and pAg of 7.5; 5 mg, per mol of silver, of sodium thiosulfate and 8 mg, per mol of silver, of chloroauric acid were added thereto; the emulsion was heated at 60° C. for 60 minutes for chemical sensitization; and 150 mg of 4-hydroxy-6-methyl-1,3,3a,7-tetrazaindene was added thereto as a stabilizer. The grains thus formed were cubic silver chlorobromide grains having a mean grain size of 0.28 μm, a silver chloride content of 70 mol % and a fluctuation coefficient of 10%.

The emulsion was divided into a plurality of parts. One$\times10^{-3}$ mol, per mol of silver, of 5-{[3-(4-sulfobutyl)-5-chloro-2-benzoxazolidylidene}ethylidene}-1-hydroxyethoxyethyl-3-(2-pyridyl)-2-thiohydantoin potassium salt was added thereto as a sensitizing dye; and $2\times10^{-4}$ mol, per mol of silver, of 1-phenyl-5-mercaptotetrazole, 50 mg/m$^2$ of a dispersion of polyethyl acrylate and a redox compound of the present invention as indicated in Table 1 were added thereto.

Simultaneous coating of a hydrazine-containing layer as a lowermost layer (Ag content: 3.6 g/m$^2$, gelatin content: 2 g/m$^2$), a redox compound-containing layer (Ag content 0.4 g/m$^2$, gelatin content: 0.5 g/m$^2$) over the hydrazine-containing layer via an interlayer (gelatin layer), and a protective layer over the redox compound-containing layer was effected, the protective layer comprising 0.5 g/m$^2$ of gelatin, 40 mg/m$^2$ of a matting agent of amorphous $SiO_2$ grains having a grain size of about 3.5 μm, 0.1 g/m$^2$ of methanol silica, 50 mg/m$^2$ of polyacrylamide, 50 mg/m$^2$ of hydroquinone, silicone oil, 5 mg/m$^2$ of a fluorine-containing surfactant having the structural formula shown below as a coating aid, and 40 mg/m$^2$ of sodium dodecylbenzenesulfonate, to prepare Sample Nos. 1 to 20 as shown in Table 1 below. These samples were evaluated and the results of evaluation are shown in Table 1.

Fluorine-Containing Surfactant $C_8F_{17}SO_2N(C_3H_7)CH_2COOK$

Backing layer and back protective layer each having the composition shown below were coated.

| Composition of Backing Layer: | |
|---|---|
| Gelatin | 3 g/m$^2$ |
| Latex Polyethyl Acrylate | 2 g/m$^2$ |
| Surfactant: | |
| Sodium p-dodecylbenzenesulfonate | 40 mg/m$^2$ |
| Gelatin Hardening Agent: | 110 mg/m$^2$ |
| $CH_2{=}CHSO_2CH_2CONH{-}(CH_2)_2{-}CONHCH_2SO_2CH{=}CH_2$ | |
| Mixture of Dyes (a), (b) and (c): | |
| Dye (a) | 50 mg/m$^2$ |
| Dye (b) | 100 mg/m$^2$ |
| Dye (c) | 50 mg/m$^2$ |

Dye (a):

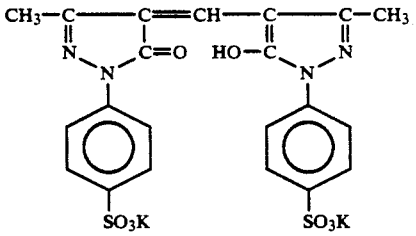

Dye (b):

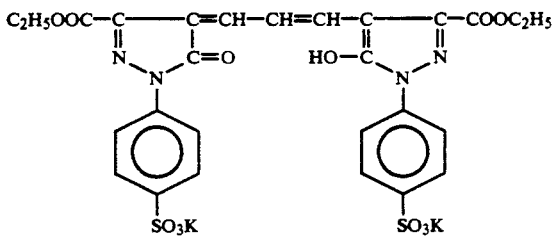

Dye (c):

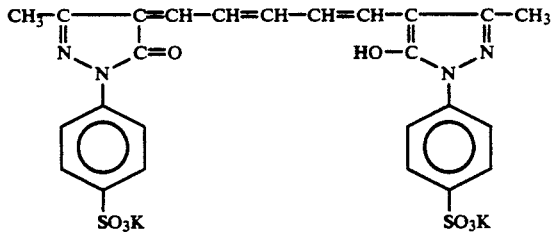

| Composition of Back Protective Layer: | |
|---|---|
| Gelatin | 0.8 mg/m$^2$ |
| Fine Grains of Polymethyl Methacrylate | 30 mg/m$^2$ |
| Sodium Dihexyl-α-sulfosuccinate | 15 mg/m$^2$ |
| Sodium Dodecylbenzenesulfonate | 15 mg/m$^2$ |
| Sodium Acetate | 40 mg/m$^2$ |
| Fluorine-containing Surfactant: | |
| $C_8F_{17}SO_2N(C_3H_7){-}CH_2COOK$ | 5 mg/m$^2$ |

A developer having the composition shown below was used for development.

| Composition of Developer: | |
|---|---|
| Hydroquinone | 50.0 g |
| N-methyl-p-aminophenol | 0.3 g |
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |

-continued

| Composition of Developer: | |
|---|---|
| 5-Methylbenzotriazole | 0.4 g |
| 2-Mercaptobenzimidazole-5-sulfonic Acid | 0.3 g |
| Sodium 3-(5-Mercaptotetrazole)benzene sulfonate | 0.2 g |
| N-n-butyldiethanolamine | 15.0 g |
| Sodium Toluenesulfonate | 8.0 g |
| Water to make | 1 liter |
| pH adjusted with Potassium Hydroxide | 11.6 |

TABLE 1

| | Redox Compound | | Gelatin Hardening Agent | | Swelling | Conditon 1 | | | | Condition 2 | | | | |
|---|---|---|---|---|---|---|---|---|---|---|---|---|---|---|
| | | | | | | Photographic Properties | | | | Photographic Properties | | | | |
| No. | Compound | Amount Added (mol/Ag mol) | Compound of Formula (A) | Amount Added (mol/Ag) mol) | Percentage (Rate) (%) | Sensitivity | γ | Image Quality | Black Peppers | Sensitivity | γ | Image Quality | Black Peppers | Notes |
| 1 | — | — | (A-1) | 35 | 130 | 100 | 18.8 | 1 | 2 | 102 | 18 | 1 | 1 | comparative sample |
| 2 | (II-18) | $3 \times 10^{-3}$ | (A-1) | 35 | 130 | 91 | 16.0 | 5 | 5 | 93 | 15.2 | 5 | 4 | sample of the invention |
| 3 | (II-11) | $3 \times 10^{-3}$ | (A-1) | 35 | 130 | 89 | 15.2 | 5 | 5 | 93 | 15.0 | 5 | 4 | sample of the invention |
| 4 | — | — | (A-1) | 45 | 113 | 105 | 19.0 | 1 | 1 | 107 | 18.0 | 1 | 1 | comparative sample |
| 5 | (II-18) | $3 \times 10^{-3}$ | (A-1) | 45 | 113 | 93 | 16.5 | 5 | 4 | 95 | 15.8 | 4 | 4 | sample of the invention |
| 6 | (II-11) | $3 \times 10^{-3}$ | (A-1) | 45 | 113 | 91 | 16.0 | 5 | 4 | 95 | 15.0 | 4 | 4 | sample of the invention |
| 7 | — | — | (A-2) | 40 | 125 | 105 | 19.0 | 1 | 1 | 107 | 18.0 | 1 | 1 | comparative sample |
| 8 | (II-18) | $3 \times 10^{-3}$ | (A-2) | 40 | 125 | 93 | 16.1 | 5 | 5 | 98 | 15.6 | 5 | 4 | sample of the invention |
| 9 | (II-11) | $3 \times 10^{-3}$ | (A-2) | 40 | 125 | 91 | 15.2 | 5 | 5 | 95 | 15.1 | 5 | 4 | sample of the invention |
| 10 | — | — | (A-2) | 50 | 110 | 107 | 18.8 | 1 | 1 | 109 | 16.2 | 1 | 1 | comparative sample |
| 11 | (II-18) | $3 \times 10^{-3}$ | (A-2) | 50 | 110 | 98 | 16.0 | 5 | 4 | 100 | 15.2 | 5 | 3 | sample of the invention |
| 12 | (II-11) | $3 \times 10^{-3}$ | (A-2) | 50 | 110 | 100 | 15.0 | 5 | 4 | 102 | 14.7 | 5 | 3 | sample of the invention |
| 13 | — | — | comparative compound (a) | 45 | 150 | 98 | 18.0 | 1 | 2 | 102 | 17.0 | 1 | 1 | comparative sample |
| 14 | (II-18) | $3 \times 10^{-3}$ | comparative compound (a) | 45 | 150 | 83 | 13.0 | 3 | 5 | 93 | 14.6 | 5 | 2 | comparative sample |
| 15 | (II-18) | $3 \times 10^{-3}$ | comparative compound (a) | 55 | 130 | 102 | 19.0 | 1 | 1 | 105 | 16.7 | 1 | 1 | comparative sample |
| 16 | (II-18) | $3 \times 10^{-3}$ | comparative compound (a) | 55 | 130 | 91 | 15.4 | 5 | 5 | 100 | 14.6 | 5 | 2 | comparative sample |
| 17 | — | — | compara- | 35 | 131 | 93 | 18.0 | 1 | 1 | 95 | 17.1 | 1 | 1 | compar- |

TABLE 1-continued

| No. | Redox Compound: Compound | Redox Compound: Amount Added (mol/Ag mol) | Gelatin Hardening Agent: Compound of Formula (A) | Gelatin Hardening Agent: Amount Added (mol/Ag) mol) | Swelling Percentage (Rate) (%) | Conditon 1: Photographic Properties: Sensitivity | Conditon 1: Photographic Properties: γ | Conditon 1: Image Quality | Conditon 1: Black Peppers | Condition 2: Photographic Properties: Sensitivity | Condition 2: Photographic Properties: γ | Condition 2: Image Quality | Condition 2: Black Peppers | Notes |
|---|---|---|---|---|---|---|---|---|---|---|---|---|---|---|
| | | | tive compound (b) | | | | | | | | | | | ative sample |
| 18 | (II-18) | $3 \times 10^{-3}$ | comparative compound (b) | 35 | 131 | 81 | 15.0 | 4 | 3 | 85 | 14.3 | 4 | 2 | comparative sample |
| 19 | — | — | comparative compound (b) | 45 | 109 | 91 | 19.0 | 1 | 1 | 95 | 17.4 | 1 | 1 | comparative sample |
| 20 | (II-18) | $3 \times 10^{-3}$ | comparative compound (b) | 45 | 109 | 79 | 14.0 | 4 | 2 | 85 | 13.6 | 4 | 1 | comparative sample |

Condition 1:
after stored under the condition of 25° C. at 55% RH for 7 days.
Condition 2:
after stored under the condition of 25° C. at 55% RH for 2 hours and then stored under the condition of 40° C. at % RH for 20 days.

As is apparent from the results of Table 1 above, Sample Nos. 2, 3, 5, 6, 8, 9, 11, and 12 of the present invention had good photographic properties and image quality and had little black peppers, even after being stored under condition 1 (25° C., 55% RH, 7 days) and under Condition 2 (after conditioned under 25° C. and 55% RH for 2 hours, then stored at 40° C. and 55% RH for 20 days). Comparative Sample No. 16 displayed properties which are similar to those of the samples of the present invention under Condition 1, but it yielded noticeable black peppers under the long-time storage test (i.e., under Condition 2). Samples No. 1 to 20 all had a water content of from 19 to 20% by weight.

Evaluation of the samples was carried out by the following tests.

Photographic Properties

For evaluating the photographic properties of the samples, each sample was developed with the developer mentioned above in an automatic developing machine FG-660F Model (manufactured by Fuji Photo Film Co.) at 34° C. for 30 seconds. As a fixer, GR-F1 was used.

The sensitivity values in Table 1 indicate a sensitivity relative to Sample No. 1 which is 100 which is the reciprocal of the exposure amount giving a density of 1.5 after development at 34° C. for 30 seconds.

The γ value is defined by the following equation:

$$\gamma = (3.0-0.3)/[\log(\text{exposure amount of giving density } 3.0) - \log(\text{exposure amount of giving density } 0.3)]$$

Evaluation to formation of black peppers was evaluated by five ranks, by microscopically observing the non-exposed area the sample developed at 34° C. for 40 seconds. "5" indicates the best, and "1" indicates the worst. "5" and "4" indicates practical samples; "3" indicates a poor sample which is critical to practical use; and "2" and "1" indicates impractical samples. The intermediate between "4" and "3" was represented by "3.5".

Evaluation of Image Quality of Line Work

An original having photo-typeset 7-grade Ming-style letters and Gothic-type letters having a reflection density falling within the range of from 0.5 to 1.2 was photographed on each sample, using a camera ("DSC351 Model", manufactured by Dai-Nippon Screen Co., Ltd.), and the exposed samples were developed under the same condition as mentioned above (34° C., 30 seconds). The processed results were evaluated by a 5-rank evaluation, in which "5" is the best and "1" is the worst. "5" and "4" indicate practical samples; "3" indicates an inferior sample which is practicable with difficulty; and "2" and "1" indicate impractical samples.

Condition 1 means that each sample was stored in an atmosphere of 25° C. and 55% RH for 7 days and that the thus stored sample was evaluated by the above-mentioned tests.

Condition 2 means that each sample was preconditioned in an atmosphere of 25° C. and 55% RH for 2 hours, then heat-sealed under the same condition and thereafter stored at 40° C. and 55% RH for 20 days, and the thus stored sample was evaluated by the above-mentioned tests. This is a test to simulate the long-time storage stability of each sample.

EXAMPLE 2

Samples Nos. 2, 8, 16 and 18 of Example 1 each were, immediately after being coated, adjusted to have a water content as indicated in Table 2 below, heat-sealed and stored at 25° C. and 55% RH for 7 days (condition 3) or at 40° C. and 55% RH for 20 days (condition 4). Then, the thus stored samples were evaluated in the same manner as in Example 1. The results obtained are shown in Table 2 below. Even the samples containing the hardening agent of the present invention, Samples Nos. 23, 24, 27 and 28 each having a high water content in the gelatin layer were found to have a deteriorated sensitivity and a lowered γ value and a noticeably deteriorated image quality.

TABLE 2

| Sample No. | Sample No. of Example 1 | Water Content (%) | Swelling Percentage (Rate) (%) | Condition 3 Photographic Characteristics Sensitivity | Condition 3 Photographic Characteristics γ | Condition 3 Image Quality | Condition 3 Black Peppers | Condition 4 Photographic Characteristics Sensitivity | Condition 4 Photographic Characteristics γ | Condition 4 Image Quality | Condition 4 Black Peppers |
|---|---|---|---|---|---|---|---|---|---|---|---|
| 21 | 2 | 16 | 140 | 91 | 14.8 | 5 | 5 | 102 | 16.0 | 5 | 5 |
| 22 | 2 | 20 | 130 | 100 | 16 | 5 | 5 | 002 | 15.2 | 5 | 4 |
| 23 | 2 | 24 | 125 | 102 | 15.6 | 5 | 5 | 98 | 15.0 | 3 | 5 |
| 24 | 2 | 26 | 122 | 102 | 15.0 | 5 | 4 | 91 | 14.0 | 2 | 5 |
| 25 | 8 | 16 | 130 | 95 | 15.2 | 5 | 5 | 100 | 16.0 | 5 | 5 |
| 26 | 8 | 20 | 125 | 102 | 16.1 | 5 | 5 | 107 | 15.6 | 5 | 4 |
| 27 | 8 | 24 | 122 | 102 | 15.8 | 5 | 5 | 98 | 14.8 | 3 | 5 |
| 28 | 8 | 26 | 120 | 105 | 15.0 | 5 | 4 | 93 | 13.6 | 2 | 5 |
| 29 | 16 | 16 | 160 | 79 | 11.8 | 4 | 5 | 98 | 15.0 | 5 | 2 |
| 30 | 16 | 20 | 130 | 100 | 15.4 | 5 | 5 | 110 | 14.6 | 5 | 2 |
| 31 | 16 | 24 | 110 | 102 | 15.0 | 5 | 4 | 100 | 13.0 | 2 | 4 |
| 32 | 16 | 26 | 100 | 105 | 14.7 | 5 | 4 | 89 | 12.6 | 2 | 4 |
| 33 | 18 | 16 | 150 | 76 | 10.9 | 4 | 4 | 87 | 14.0 | 4 | 3 |
| 34 | 18 | 20 | 131 | 89 | 15.0 | 4 | 3 | 93 | 14.3 | 4 | 2 |
| 35 | 18 | 24 | 122 | 91 | 14.8 | 4 | 3 | 95 | 14.0 | 2 | 4 |
| 36 | 18 | 26 | 110 | 93 | 14.7 | 4 | 3 | 79 | 12.0 | 1 | 4 |

EXAMPLE 3

The combination of Hydrazine Compounds (c) and (d) in Example 1 was changed to a combination of Hydrazine Compounds (e) and (f) or to a combination of Hydrazine Compounds (g) and (h). Both latter combinations gave excellent photographic properties along with the combination of the redox compound and the gelatin hardening agent of the present invention.

EXAMPLE 4

Sample Nos. 41 and 43 were prepared in the same manner as in preparation of Sample No. 2 of Example 1, except that the sensitizing dye and the dye in the backing layer were changed to those shown below.

Sample Nos. 41 and 43 each containing a spectral sensitizing dye represented by formula (S) and a dye represented by formula (F) of the present invention, had a high sensitivity and a high safety to a safelight. The safety to a safelight was evaluated on the basis of the Hydrazine Compound (e):

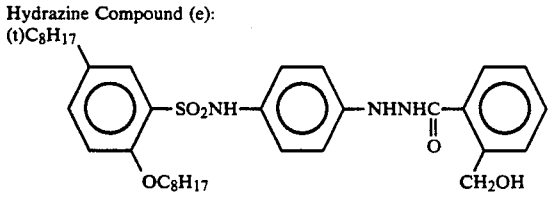

Hydrazine Compound (f):

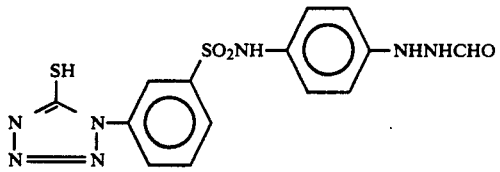

Hydrazine compound (g):

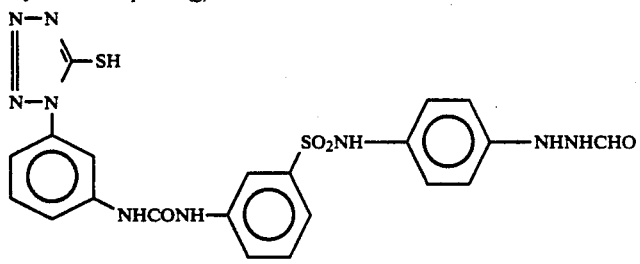

Hydrazine Compound (h):

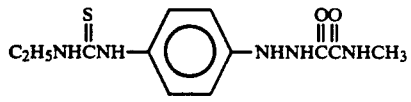

increment of fog of each sample as exposed to a safelight for a long period of time.

| Sample No. | Sensitizing Dye: Compound of Formula (S) | Sensitizing Dye: Amount Added (mol/mol of Ag) | Dye: Compound of Formula (F) | Dye: Amount Added ($mg/m^2$) |
|---|---|---|---|---|
| 41 | S-2 | $3.5 \times 10^{-4}$ | F-8 | 10 |
| 42 | S-4 | $4.2 \times 10^{-4}$ | F-8 | 10 |
| 43 | S-7 | $4.2 \times 10^{-4}$ | F-12 | 10 |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one light-sensitive silver halide emulsion layer and another hydrophilic colloid layer, wherein at least one of the emulsion layer or the other hydrophilic colloid layer contains a hydrazine derivative and a redox compound capable of releasing a development inhibitor by oxidation and further contains at least one hardening agent represented by formula (A):

$$CH_2{=}CHSO_2\underset{\underset{R}{|}}{CH}(O\underset{\underset{R}{|}}{CH})_nSO_2CH{=}CH_2 \qquad (A)$$

wherein R represents a hydrogen atom, a substituted or unsubstituted alkyl group, a substituted or unsubstituted aralkyl group or a substituted or unsubstituted aryl group; and n represents 0 or 1; which material has a water content of 22% by weight or less based on the total gelatin weight.

2. The silver halide photographic material as claimed in claim 1, wherein at least one of the emulsion layer or the other hydrophilic colloid layer further contains a spectral sensitizing dye represented by formula (S):

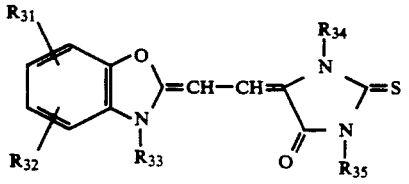

(S)

wherein $R_{31}$ and $R_{32}$ each represents a hydrogen atom, a halogen atom, a substituted or unsubstituted alkyl group having from 1 to 8 carbon atoms, a hydroxyl group, an alkoxy group, a phenyl group, a naphthyl group, a sulfo group or a carboxyl group, and $R_{31}$ and $R_{32}$ may be bonded to each other to form a 6-membered ring;

$R_{33}$ represents a substituted or unsubstituted alkyl or alkenyl group;

$R_{34}$ represents a hydrogen atom, or a substituted or unsubstituted alkyl group having from 1 to 12 carbon atoms;

$R_{35}$ represents a pyridyl group which may be or not substituted by at least one substituent selected from the group consisting of a halogen atom, a lower alkyl group, a hydroxyl group, a hydroxyalkyl group, an alkoxy group, a sulfo group and a carboxyl group.

3. The silver halide photographic material as claimed in claim 1, wherein at least one of the emulsion layer or the other hydrophilic colloid layer further contains a dye represented by formula (F):

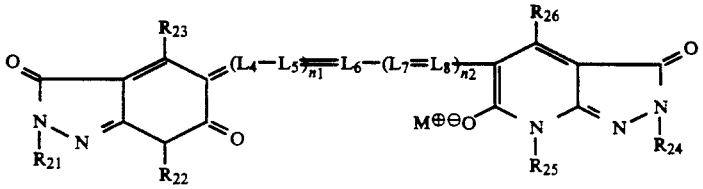

(F)

wherein $R_{21}$ and $R_{24}$ each represents a hydrogen atom, an aliphatic group, an aromatic group or a heterocyclic group;

$R_{22}$ and $R_{25}$ each represents a hydrogen atom, an aliphatic group, an aromatic group, a heterocyclic group, $—COR_{29}$ or $—SO_2R_{29}$;

$R_{23}$ and $R_{26}$ each represents a hydrogen atom, a cyano group, an alkyl group, an aryl group, $—COOR_{27}$, $—OR_{27}$, $—NR_{27}R_{28}$, $—N(R_{28})COR_{29}$, $—N(R_{28})SO_2R_{29}$, $—CONR_{27}R_{28}$, or $—N(R_{27})CONR_{27}R_{28}$, in which $R_{29}$ represents an aliphatic group or an aromatic group, and $R_{27}$ and $R_{28}$ each represents a hydrogen atom, an aliphatic group or an aromatic group;

$L_4$, $L_5$, $L_6$, $L_7$ and $L_8$ each represents a methine group;

$n_1$ and $n_2$ each represents 0 or 1;

$M^+$ represents a hydrogen atom or a monovalent cation; provided that at least one of $R_{21}$, $R_{22}$, $R_{23}$, $R_{24}$, $R_{25}$, $R_{26}$, $L_4$, $L_5$, $L_6$, $L_7$ and $L_8$ is a group having at least one carboxylic acid group or sulfonic acid group.

4. The silver halide photographic material as claimed in claim 1, wherein said redox compound is at least one compound selected from the group consisting of compounds represented by formulae (R-1), (R-2) or (R-3):

(R-1)

$$R_1—\underset{\underset{A_1}{|}}{N}—\underset{\underset{A_2}{|}}{N}—G_1\text{-(Time)}_r\text{-PUG}$$

(R-2)

$$R_1—G_2—G_1—\underset{\underset{A_1}{|}}{N}—\underset{\underset{A_3}{|}}{N}—\underset{\underset{A_4}{|}}{CH_2CH}\text{-(Time)}_r\text{-PUG}$$

(R-3)

-continued

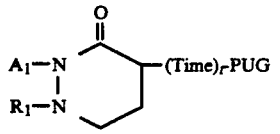

wherein $R_1$ represents an aliphatic group or an aromatic group; $G_1$ represents —CO—, —CO—CO—, —CS—, —C(=N—$G_2$—$R_2$)—, —SO—, —$SO_2$— or —P(O)($G_2$—$R_2$)—; $G_2$ represents a mere chemical bond or represents —O—, —S— or —$NR_2$—; $R_2$ represents a hydrogen atom or a group defined for $R_1$; $A_1$ and $A_2$ each represents a hydrogen atom, an alkylsulfonyl group, an arylsulfonyl group or an acyl group, which may be or not substituted; provided that in the formula (R-1), at least one of $A_1$ and $A_2$ must be a hydrogen atom, and $A_3$ has the same meaning as $A_1$ or represents —$CH_2$—C($A_4$)H—(Time)$_t$—PUG wherein $A_4$ represents a nitro group, a cyano group, a carboxy group, a sulfo group or —$G_1$—$G_2$—$R_1$, Time represents a divalent linking group, t represents 0 or 1 and PUG represents a development inhibitor.

5. The silver halide photographic material as claimed in claim 1, wherein said hardening agent represented by formula (A) is contained in the photographic material in an amount of 0.01 to 20% by weight based on the dry gelatin therein.

6. The silver halide photographic material as claimed in claim 1, wherein said hydrazine derivative is contained in the photographic material in an amount of $1\times10^{-6}$ mol to $5\times10^{-2}$ mol per mol of the silver halide.

7. The silver halide photographic material as claimed in claim 1, wherein said redox compound is contained in the photographic material in an amount of $1\times10^{-6}$ to $5\times10^{-2}$ mol per mol of the silver halide.

8. The silver halide photographic material as claimed in claim 1, wherein said hydrazine derivative is added to the emulsion layer.

9. The silver halide photographic material as claimed in claim 1, wherein said redox compound is added to a layer containing no hydrazine nucleating agent.

* * * * *